US009833038B2

(12) United States Patent
Foxen et al.

(10) Patent No.: US 9,833,038 B2
(45) Date of Patent: Dec. 5, 2017

(54) MULTI-DENSITY MIDSOLE AND PLATE SYSTEM

(71) Applicant: NIKE, Inc., Beaverton, OR (US)

(72) Inventors: Thomas Foxen, Portland, OR (US); Kevin W. Hoffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 34 days.

(21) Appl. No.: 14/662,718

(22) Filed: Mar. 19, 2015

(65) Prior Publication Data

US 2016/0270475 A1 Sep. 22, 2016

(51) Int. Cl.

| | |
|---|---|
| ***A43B 13/12*** | (2006.01) |
| ***A43B 7/14*** | (2006.01) |
| ***A43B 13/14*** | (2006.01) |
| ***A43B 13/18*** | (2006.01) |
| ***A43B 13/42*** | (2006.01) |

(52) U.S. Cl.

CPC ..... *A43B 13/127* (2013.01); *A43B 7/146* (2013.01); *A43B 7/1445* (2013.01); *A43B 13/141* (2013.01); *A43B 13/145* (2013.01); *A43B 13/181* (2013.01); *A43B 13/183* (2013.01); *A43B 13/186* (2013.01); *A43B 13/188* (2013.01); *A43B 13/42* (2013.01)

(58) Field of Classification Search

CPC ..... A43B 13/12; A43B 13/125; A43B 13/127; A43B 3/0047; A43B 13/36

See application file for complete search history.

(56) References Cited

U.S. PATENT DOCUMENTS

| | | | | | |
|---|---|---|---|---|---|
| 1,281,539 | A | * | 10/1918 | Engel | A43B 13/12 12/146 B |
| 1,432,961 | A | * | 10/1922 | Brown | A43B 13/12 36/32 R |
| 2,268,709 | A | * | 1/1942 | Kelly | A43B 9/02 12/146 BP |
| 2,333,201 | A | * | 11/1943 | Russell | A43B 13/04 36/30 R |
| 3,103,931 | A | | 9/1963 | Knellwolf | |
| 4,043,058 | A | | 8/1977 | Hollister et al. | |
| 4,074,446 | A | | 2/1978 | Eisenberg | |
| 4,420,894 | A | * | 12/1983 | Glassman | A43B 13/28 36/107 |

(Continued)

FOREIGN PATENT DOCUMENTS

| | | | |
|---|---|---|---|
| EP | 1330965 | A1 | 7/2003 |
| FR | 2781989 | A1 | 2/2000 |
| WO | 2008-146376 | A1 | 12/2008 |

OTHER PUBLICATIONS

International Search Report and Written Opinion dated Jun. 6, 2016 for PCT Application No. PCT/US2016/022088.

*Primary Examiner* — Megan Brandon

(74) *Attorney, Agent, or Firm* — Honigman Miller Schwartz and Cohn LLP; Matthew H. Szalach; Jonathan P. O'Brien

(57) ABSTRACT

A sole structure and an article of footwear that includes an upper midsole component, a lower midsole component, and a plate. The lower midsole component includes a raised portion that acts as a fulcrum or pivot point. The raised portion may be attached to the plate. The plate may be able to pivot in response to forces on the lateral side and the medial side.

20 Claims, 16 Drawing Sheets

(56) References Cited

U.S. PATENT DOCUMENTS 4,674,205 A * 6/1987 Anger ..... A43B 7/142 36/30 R
4,730,402 A * 3/1988 Norton ..... A43B 13/187 36/114
5,077,915 A * 1/1992 Gross ..... A43B 13/12 36/114
5,542,196 A * 8/1996 Kantro ..... A43B 1/0045 36/174
5,572,805 A * 11/1996 Giese ..... A43B 13/12 36/103
5,657,556 A * 8/1997 Bemis ..... A43B 13/12 12/142 P
5,720,117 A * 2/1998 Toschi ..... A43B 23/22 36/169
5,768,801 A * 6/1998 Huff ..... A43B 7/1425 12/142 D
5,771,606 A * 6/1998 Litchfield ..... A43B 13/20 36/28
5,937,544 A * 8/1999 Russell ..... A43B 7/1425 36/27
6,038,790 A * 3/2000 Pyle ..... A43B 7/1425 36/28
6,092,307 A * 7/2000 Singer ..... A43B 9/00 36/12
6,327,795 B1 * 12/2001 Russell ..... A43B 13/145 36/27
6,675,502 B1 * 1/2004 Chen ..... A43B 13/12 36/25 R
7,194,826 B2 3/2007 Ungari
7,395,616 B2 7/2008 Fallon
7,748,143 B2 7/2010 Mathieu et al.
8,151,485 B2 4/2012 Hurd et al.
8,220,185 B2 7/2012 Baker et al.
8,479,416 B2 * 7/2013 Auger ..... A43B 7/1445 36/102
2002/0089805 A1 * 7/2002 Maritz ..... A43B 13/12 361/224
2003/0172548 A1 * 9/2003 Fuerst ..... A43B 13/026 36/28
2003/0200676 A1 * 10/2003 Gross ..... A43B 1/0081 36/15
2004/0181970 A1 * 9/2004 Covatch ..... A43B 7/1425 36/30 R
2005/0144811 A1 7/2005 Harb
2005/0268490 A1 * 12/2005 Foxen ..... A43B 7/1425 36/28
2007/0277401 A1 * 12/2007 Young-Chul ..... A43B 13/12 36/30 R
2009/0019730 A1 * 1/2009 Salminen ..... A43B 7/1425 36/91
2009/0064535 A1 * 3/2009 Spanks ..... A43B 1/0072 36/19.5
2009/0126230 A1 * 5/2009 McDonald ..... A43B 1/0063 36/88
2009/0172971 A1 * 7/2009 Peikert ..... A43B 7/125 36/88
2009/0320330 A1 * 12/2009 Borel ..... A43B 13/026 36/30 R
2010/0005684 A1 * 1/2010 Nishiwaki ..... A43B 7/1425 36/28
2010/0287796 A1 * 11/2010 Koo ..... A43B 13/12 36/30 R
2011/0061264 A1 * 3/2011 Solymosi ..... A43B 7/142 36/88
2011/0138659 A1 * 6/2011 Park ..... A43B 3/0047 36/25 R
2011/0192049 A1 * 8/2011 Auger ..... A43B 7/1445 36/44
2011/0197469 A1 8/2011 Nishiwaki et al.
2011/0302809 A1 * 12/2011 Kim ..... A43B 13/127 36/103
2012/0036740 A1 * 2/2012 Gerber ..... A43B 5/02 36/134
2012/0055041 A1 3/2012 Mackey et al.
2012/0210606 A1 * 8/2012 Gheorghian ..... A43B 5/06 36/103
2012/0227289 A1 * 9/2012 Beers ..... A43B 3/128 36/25 R
2012/0291309 A1 * 11/2012 Ludemann ..... A43B 7/144 36/83
2012/0324758 A1 * 12/2012 Tang ..... A43B 13/12 36/28
2013/0139410 A1 * 6/2013 Dirsa ..... A43B 13/28 36/103
2013/0291409 A1 * 11/2013 Reinhardt ..... A43B 13/04 36/30 R
2014/0075778 A1 * 3/2014 Bruce ..... A43B 13/184 36/29
2014/0182170 A1 * 7/2014 Wawrousek ..... A43B 7/14 36/103
2015/0082668 A1 * 3/2015 Nonogawa ..... A43B 5/10 36/30 R
2015/0164180 A1 * 6/2015 Lee ..... A43B 7/142 36/105
2016/0021972 A1 * 1/2016 Grelle ..... A43B 3/0057 36/140

* cited by examiner

MULTI-DENSITY MIDSOLE AND PLATE SYSTEM

BACKGROUND

Articles of footwear typically have at least two major components, an upper that provides the enclosure for receiving the wearer's foot, and a sole structure secured to the upper that is the primary contact to the ground or playing surface. The footwear may also use some type of fastening system, for example, laces or straps or a combination of both, to secure the footwear around the wearer's foot. The sole structure may comprise an inner sole, midsoles, and an outsole or a combination of one or more soles. The midsole may be used to provide cushioning that attenuates forces from walking, running, or the like.

The outsole is the primary contact to the ground of the playing surface. The outsole may carry a tread pattern and/or cleats, spikes or other protuberances that provide the wearer of the footwear with improved traction suitable to the particular athletic, work or recreational activity, or to a particular surface. The outsole may provide traction to the article of footwear by maintaining contact with the ground. When a user cuts or moves laterally a portion of the outsole may lift off of the ground, diminishing the contact area between the article of footwear and the ground thereby lessening the traction between the article of footwear and the ground.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the Figures, like reference numerals designate corresponding parts throughout the different views.

DETAILED DESCRIPTION

Figure 1:
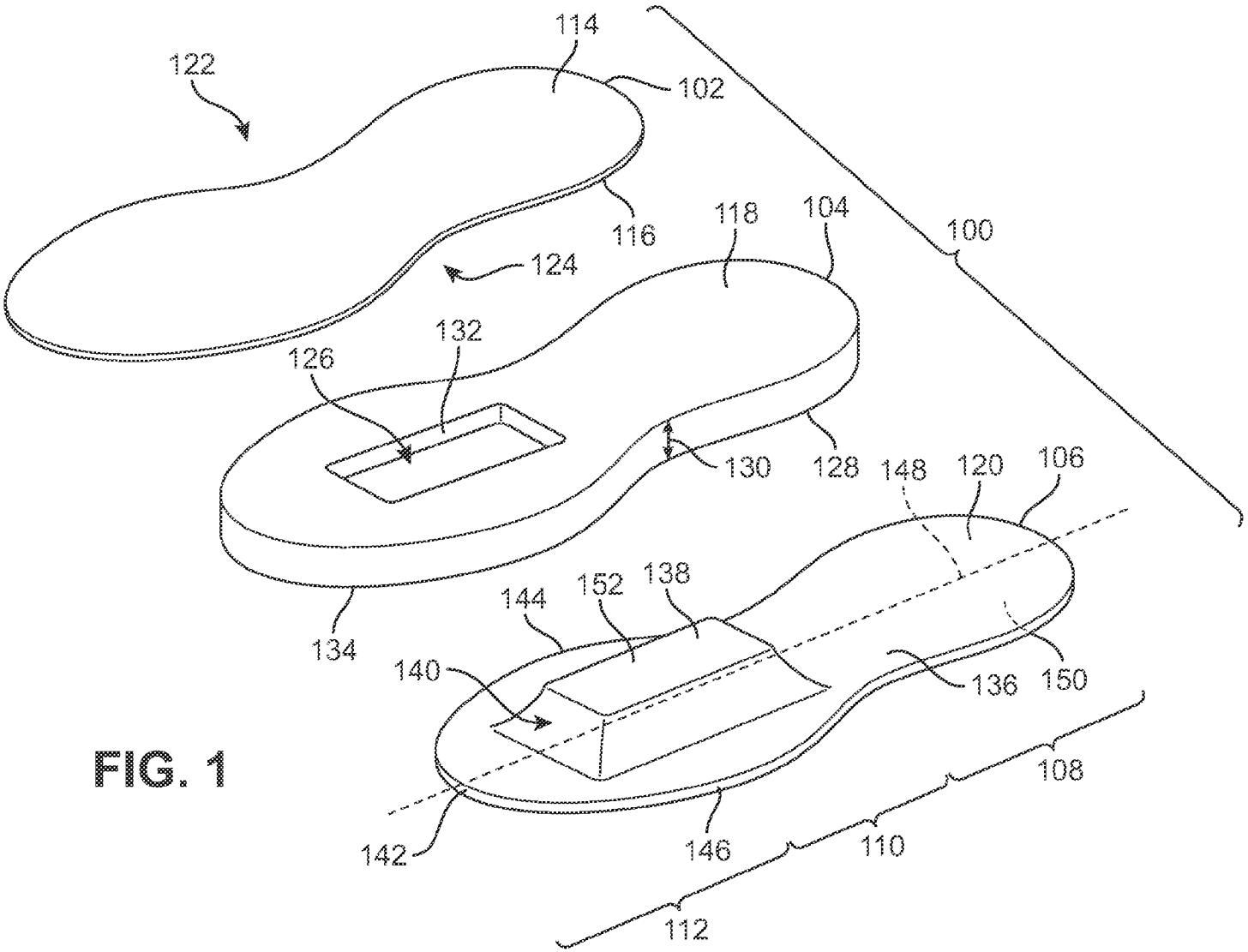
FIG. 1 is an exploded isometric view of an embodiment of a multi-density sole structure.

In one aspect, a sole structure includes a plate, an upper midsole component, and a lower midsole component. The upper midsole component has an upper surface and a lower surface, and the upper midsole component has an opening. The lower midsole component has an upper surface and a lower surface, the lower midsole component being located adjacent to the upper midsole component. The lower midsole component includes a raised portion, the raised portion having an upper surface, the raised portion extending through the opening. The upper surface of the raised portion being in the same plane as the upper surface of the upper midsole component. The plate contacting the upper surface of the upper midsole component. The plate being secured to the upper surface of the raised portion.

In another aspect, an article of footwear includes an upper and a sole structure. The sole structure includes a plate, an upper midsole component, and a lower midsole component. The upper midsole component has an upper surface and a lower surface. The lower midsole component has an upper surface and a lower surface. The lower midsole component being located adjacent to the upper midsole component. The lower midsole component including a base portion and a raised portion. The base portion having an upper surface and a lower surface and the raised portion having an upper surface. The upper surface of the raised portion being in the same plane as the upper surface of the upper midsole component. The plate contacting a portion of the upper surface of the upper midsole component. The upper surface of the base portion being attached to the lower surface of the upper midsole component. The plate being secured to the upper surface of the raised portion.

In another aspect, a method of making a sole structure includes providing a lower midsole component and an upper midsole component. The upper midsole component having an upper surface and a lower surface. The lower midsole component having an upper surface and a lower surface. The upper midsole component further includes an opening. The lower midsole component includes a raised portion. The method further includes positioning the raised portion within the opening of the upper midsole component such that the upper surface of the raised portion is located within the same plane as the upper surface of the upper midsole component.

Further, the method includes joining the lower midsole component adjacent to the upper midsole component. The method also includes locating a plate adjacent the lower midsole component and the upper midsole component and securing the plate to the raised portion of the lower midsole component.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

For clarity, the detailed descriptions herein describe certain exemplary embodiments, but the disclosure herein may be applied to any article of footwear comprising certain features described herein and recited in the claims. In particular, although the following detailed description discusses exemplary embodiments in the form of footwear such as running shoes, jogging shoes, tennis, squash or racquetball shoes, basketball shoes, sandals and flippers, the disclosures herein may be applied to a wide range of footwear or possibly other kinds of articles.

For consistency and convenience, directional adjectives are employed throughout this detailed description corresponding to the illustrated embodiments. The term "longitudinal direction" as used throughout this detailed description and in the claims refers to a direction extending from heel to toe, which may be associated with the length, or longest dimension, of an article of footwear such as a sports or recreational shoe and components thereof. Also, the term "lateral direction" as used throughout this detailed description and in the claims refers to a direction extending from side to side (lateral side and medial side) or the width of an article of footwear or components thereof. The lateral direction may generally be perpendicular to the longitudinal direction. The term "vertical direction" as used with respect to an article of footwear throughout this detailed description and in the claims refers to the direction that is normal to the plane of the sole structure of the article of footwear. Moreover, the vertical direction may generally be perpendicular to both the longitudinal direction and the lateral direction.

FIG. 1 is an exploded view of an embodiment of a multi-density sole structure 100. Sole structure 100 may comprise a plate 102, an upper midsole component 104, and a lower midsole component 106. In some embodiments, sole structure 100 may further comprise an outsole (not shown). In some embodiments, the outsole may comprise ground engaging devices. In some embodiments, the outsole may include studs or cleats.

Sole structure 100 has a heel region 108, an instep or midfoot region 110, and a forefoot region 112. These regions may also be applied to components of sole structure 100 and their relative position in relation to sole structure 100. The regions are not intended to demarcate precise areas of a sole structure or article of footwear. Rather, forefoot region 112, midfoot region 110, and heel region 108 are intended to represent general areas of sole structure 100 to aid in the following discussion.

In some embodiments, plate 102 may correspond to the shape of a foot. In some embodiments, plate 102 may extend from medial side 124 to lateral side 122 of plate 102. Lateral side 122 corresponds with an outside area of the foot, and medial side 124 corresponds with an inside area of the foot (i.e., the surface that faces toward the other foot). Lateral side 122 and medial side 124 may also be applied to sole structure 100 and individual elements thereof, as well as additional elements such as an upper. In other embodiments, plate 102 may extend partially from medial side 124 to lateral side 122. That is, in some embodiments, plate 102 may not cover the entire surface area of upper midsole component 104 or lower midsole component 106.

In some embodiments, plate 102 may be continuous from heel region 108 to forefoot region 112. In other embodiments, plate 102 may comprise distinct sections. That is, in some embodiments, plate 102 may include a heel portion and a forefoot portion without a midfoot portion. In other embodiments, plate 102 may include discrete portions corresponding to heel region 108, midfoot region 110, and forefoot region 112 of sole structure 100. In other embodiments, plate 102 may extend from forefoot region 112 to midfoot region 110 of sole structure 100. In still further embodiments, plate 102 may extend from midfoot region 110 to heel region 108 of sole structure 100.

In some embodiments, a portion of upper midsole component 104 and/or a portion of lower midsole component 106 may contact plate 102. Upper surface 114 of plate 102 may be oriented toward a foot and lower surface 116 of plate 102 may be oriented toward upper midsole component 104 and lower midsole component 106. In some embodiments, lower surface 116 of plate 102 may contact upper surface 118 of upper midsole component 104. In other embodiments, lower surface 116 of plate 102 may contact the upper surface of lower midsole component 106. In still further embodiments, lower surface 116 of plate 102 may contact upper surface 118 of upper midsole component 104 as well as the upper surface of lower midsole component 106.

Compressibility as used throughout this Detailed Description relates to the volume change of a material in response to a force or pressure. For example, in order to compare the compressibility of a first material and a second material, each of the first material and the second material may be exposed to the same force. If the volume of the first material is decreased by a greater amount than the volume of the second material then the first material may be characterized as more compressible than the second material. Compressibility as used throughout this Detailed Description may also be used to describe the properties of an object rather than the material itself.

Rigidity as used throughout this Detailed Description relates to the extent to which a material deforms in response to an applied force. Stiffness as used throughout this Detailed Description relates to the rigidity of an object, rather than the material itself. In some cases, rigidity and stiffness may be used interchangeably.

In different embodiments, a plate could be made of various materials. Exemplary materials include, but are not limited to: plastics, composite materials, metals, as well as possibly other materials. In some cases, a material that is relatively rigid or incompressible could be selected for plate 102. Examples of such materials include, for example, fiber composite materials, such as carbon fiber composites.

In different embodiments, the rigidity of plate 102 could vary. In some embodiments, plate 102 could have a substantially uniform rigidity throughout forefoot region 112, midfoot region 110 and heel region 108. In other embodiments, plate 102 may be composed of materials of varying rigidity throughout plate 102. For example, plate 102 may be relatively rigid in forefoot region 112. Plate 102 may be relatively flexible in heel region 108. Midfoot region 110 of plate 102 may be composed of a material that has a rigidity between the rigidity of plate 102 in forefoot region 112 and heel region 108.

In some embodiments upper midsole component 104 may be made of a various materials. Exemplary materials include, but are not limited to: a polymer foam element (e.g. a polyurethane or ethylvinylacetate foam), plastics, rubber and other materials that may compress during walking, running or other ambulatory activities.

In some embodiments lower midsole component 106 may be made of a various materials. Exemplary materials include, but are not limited to: a polymer foam element (e.g. a polyurethane or ethylvinylacetate foam), plastics, rubber and other materials that may compress during walking, running or other ambulatory activities.

Materials for each of plate 102, upper midsole component 104 and lower midsole component 106 may be selected to achieve desired properties for each component, such as compressibility, rigidity and/or stiffness. In some embodiments, each of plate 102, upper midsole component 104 and lower midsole component 106 could have different material properties in order to enhance cushioning and dynamic properties of sole structure 100, as discussed in further detail below.

In some embodiments, upper midsole component 104 may have a first compressibility, lower midsole component 106 may have a second compressibility and plate 102 may have a third compressibility. The first compressibility of upper midsole component 104 may be more compressible than the second compressibility of lower midsole component 106. In some embodiments, the second compressibility of lower midsole component 106 may be more compressible than the third compressibility of plate 102.

In some embodiments, the material used to form plate 102 may have a first rigidity, the material used to form lower midsole component 106 may have a second rigidity, and the material used to form upper midsole component 104 may have a third rigidity. The first rigidity of the material used to form plate 102 may be greater than the second rigidity of the material used to form lower midsole component 106. The second rigidity of the material used to form lower midsole component 106 may be greater than the third rigidity of the material used to form upper midsole component 104. In some embodiments, upper midsole component 104 may be formed from a material having a higher rigidity than the material used to form lower midsole component 106.

In some embodiments, plate 102 may have a first stiffness, lower midsole component 106 may have a second stiffness, and upper midsole component 104 may have a third stiffness. The first stiffness of plate 102 may be greater than the second stiffness of lower midsole component 106. The second stiffness of lower midsole component 106 may be greater than the third stiffness of upper midsole component 104. In some embodiments, upper midsole component 104 may be stiffer than lower midsole component 106.

In some embodiments, the density or compressibility of a material may be manipulated or changed throughout upper midsole component 104. For example, in some embodiments, the material of upper midsole component 104 may be greater in density, or less compressible, in heel region 108 of upper midsole component 104 than in midfoot region 110 or forefoot region 112. Additionally, the material of lower midsole component 106 may be varied in a similar manner.

In some embodiments, upper midsole component 104 may correspond to the shape of a foot. In some embodiments, upper midsole component 104 may further correspond to the shape of plate 102. In some embodiments, upper midsole component 104 may extend along the length of plate 102. In other embodiments, upper midsole component 104 may be discontinuous. For example, in some embodiments, forefoot region 112 of upper midsole component 104 may be a discrete separate piece from the heel region 108 of upper midsole component 104.

In some embodiments, upper midsole component 104 may have a uniform thickness. In other embodiments, thickness 130 may vary throughout upper midsole component 104. For example, in some embodiments, thickness 130 may be greater in heel region 108 of upper midsole component 104 than in forefoot region 112 of upper midsole component 104. In still further embodiments, thickness 130 may vary from lateral side 122 to medial side 124.

In some embodiments, upper midsole component 104 may include an opening 126. In some embodiments, opening 126 may extend from upper surface 118 to lower surface 128 of upper midsole component 104. In other embodiments, opening 126 may pass only partially through upper midsole component 104. In some embodiments, lower surface 128 may include a depression that extends from lower surface 128 toward upper surface 118 of upper midsole component 104. In some embodiments, the depression may not extend completely from lower surface 128 to upper surface 118.

In some embodiments, opening 126 may have a regular shape. In some embodiments, including the embodiment shown in FIG. 1, opening 126 may have a rectangular shape. In other embodiments, opening 126 may be irregular in shape. In another embodiment, shown in FIG. 15, opening 126 may have a triangular shape.

In some embodiments, opening 126 may be located within a particular region of upper midsole component 104. In some embodiments, opening 126 may be located in forefoot region 112 of upper midsole component 104. In other embodiments, opening 126 may be located in midfoot region 110 of upper midsole component 104. In still further embodiments, opening 126 may be located in heel region 108 of upper midsole component 104. In further embodiments, opening 126 may be present in one or more of heel region 108, midfoot region 110, and/or forefoot region 112. In the embodiment shown in FIG. 1, opening 126 is disposed in forefoot region 112 and extends partially into midfoot region 110.

In some embodiments, multiple openings may be present in upper midsole component 104. In some embodiments, multiple distinct openings may be present in a particular region. For example, in some embodiments, multiple openings may be located in forefoot region 112. In other embodiments, multiple openings may be located within various regions. For example, in some embodiments, a distinct opening may be located in forefoot region 112, and a distinct opening may be located within heel region 108. Additionally, multiple openings may be located within upper midsole component 104 in forefoot region 112, midfoot region 110 and/or heel region 108.

In some embodiments, inner faces 132 of opening 126 may extend in a completely vertical direction. That is, in some embodiments, the edge of inner faces 132 located on upper surface 118 may be located directly above the edge of inner faces 132 located on lower surface 128 of upper midsole component 104. In other embodiments, inner faces 132 may flare towards edge 134 as inner faces 132 extend from upper surface 118 to lower surface 128 of upper midsole component 104.

In some embodiments, lower midsole component 106 may comprise a base portion 136 and a raised portion 138. In some embodiments, base portion 136 and raised portion 138 may be made of the same material. In other embodiments, base portion 136 and raised portion 138 may be made of different materials.

In some embodiments, base portion 136 may be made of a less compressible material than is raised portion 138. In other embodiments, raised portion 138 may be less compressible than base portion 136. In still further embodiments, base portion 136 and raised portion 138 may be formed from material having the same compressibility properties. In some embodiments, for example, base portion 136 and raised portion 138 may comprise a single monolithic component (e.g., base portion 136 and raised portion 138 are integrally formed together).

In some embodiments, the compressibility of lower midsole component 106 may vary from forefoot region 112 to heel region 108. That is, in some embodiments, forefoot region 112 of lower midsole component 106 may include a material that has a higher compressibility than the material in heel region 108 of lower midsole component 106.

In some embodiments, lower midsole component 106 may correspond in shape to a foot. In other embodiments, lower midsole component 106 may correspond in shape to upper midsole component 104.

In some embodiments, lower midsole component 106 may extend along the length of upper midsole component 104. In other embodiments, lower midsole component 106 may be discontinuous. For example, in some embodiments, the forefoot region 112 of lower midsole component 106 may be a discrete, separate piece from the heel region 108 of lower midsole component 106.

In some embodiments, raised portion 138 may be a discrete piece. That is, in some embodiments, there may be no base portion 136. In other embodiments, base portion 136 may be smaller. For example, base portion 136 may only be located in forefoot region 112 of lower midsole component 106. In other embodiments, base portion 136 may extend from forefoot region 112 to midfoot region 110 or heel region 108. In still further embodiments, base portion 136 may only be located in the region or regions in which raised portion 138 is located.

Figure 2:
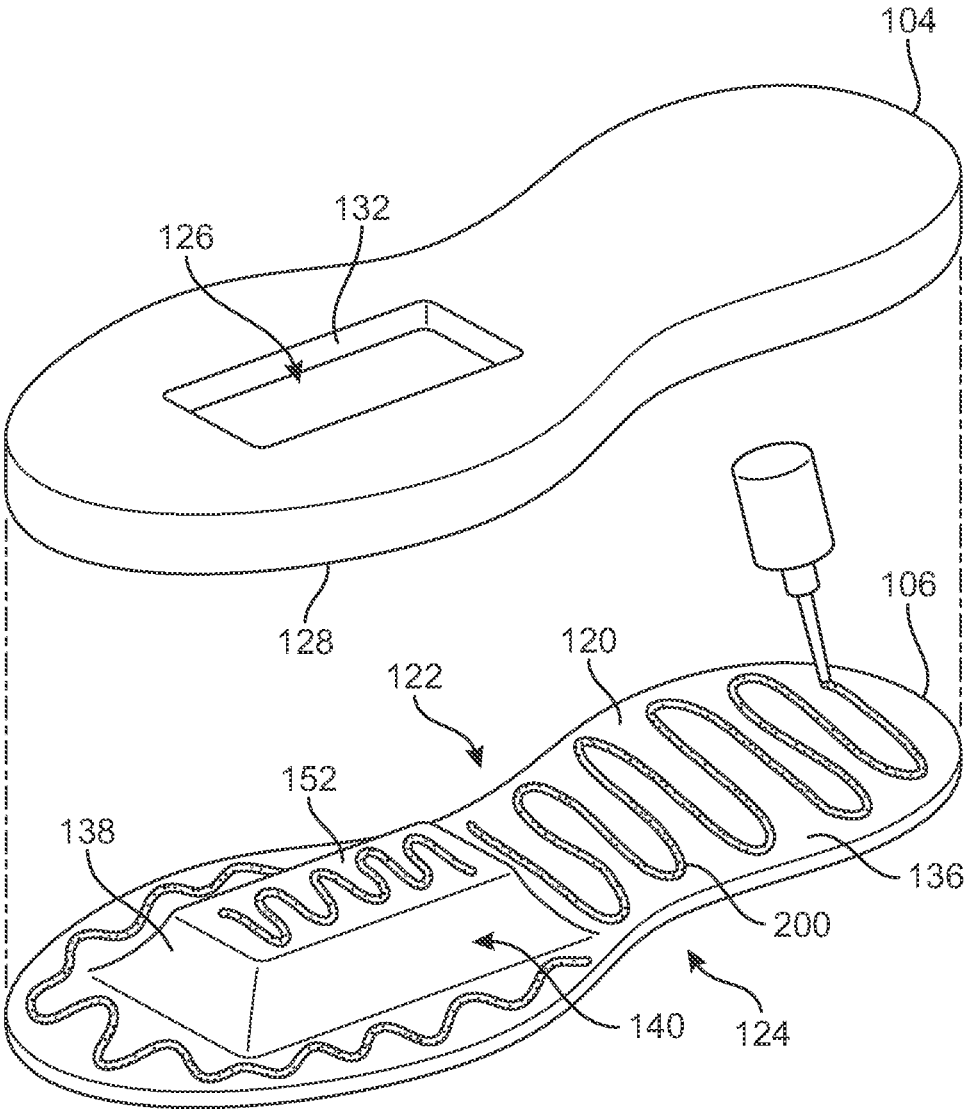
FIG. 2 is an isometric view of an embodiment of two portions of a midsole.

In some embodiments, upper surface 120 of base portion 136 may contact lower surface 128 of upper midsole component 104. In some embodiments, upper surface 120 and lower surface 128 may be bonded together as shown in FIG. 2 and discussed in further detail below.

In some embodiments, the shape of raised portion 138 may correspond to the shape of opening 126. In some embodiments, lower midsole component 106 may be brought together with upper midsole component 104. In some embodiments, raised portion 138 may be inserted into opening 126. In some embodiments, raised portion 138 may be aligned with opening 126 such that upper surface 152 of raised portion 138 may be located in the same plane as upper surface 118 of upper midsole component 104.

In some embodiments, outer faces 140 of raised portion 138 may correspond in shape with inner faces 132 of upper midsole component 104. In some embodiments, inner faces 132 and outer faces 140 may correspond so as to create a compression fit between raised portion 138 and opening 126. In other embodiments, raised portion 138 and opening 126 may be shaped and sized such that outer faces 140 and inner faces 132 do not interact. In other embodiments, outer faces 140 and inner faces 132 may contact each other without forming a compression fit.

In some embodiments, raised portion 138 may be of uniform height, or distance in the vertical direction. Height 402 (See FIG. 4) of raised portion 138 may correspond to the distance from upper surface 120 of base portion 136 to upper surface 152 of raised portion 138. In some embodiments, height 402 of raised portion 138 may vary along the longitudinal direction or the length of raised portion 138. In some embodiments, raised portion 138 may be a greater height at the location furthest from heel region 108. In other embodiments, raised portion may be a smaller height at the location furthest from heel region 108. In still other embodiments, height 402 of raised portion 138 may correspond to the thickness of upper midsole component 104. In such embodiments, upper surface 152 of raised portion 138 may match the plane of upper surface 118 of upper midsole component 104 when assembled with upper midsole component 104.

In some embodiments, raised portion 138 may extend from forefoot region 112 to heel region 108. In other embodiments, raised portion 138 may extend through one or more of forefoot region 112, midfoot region 110, and heel region 108. In still further embodiments, raised portion 138 may be located in a distinct region. As shown, a portion of base portion 136 is located between raised portion 138 and forefoot end 142. In some embodiments, raised portion may extend to, or near, forefoot end 142 of lower midsole component 106. In some embodiments, the length of raised portion 138 may approximately correspond to the length of opening 126 in upper midsole component 104.

In some embodiments, raised portion 138 may extend from lateral side 122 to medial side 124. The width of raised portion 138 may be the distance that raised portion 138 covers or extends between lateral side 122 and medial side 124. In some embodiments, a portion of base portion 136 may extend between medial edge 146 and raised portion 138. Additionally, in some embodiments, a portion of base portion 136 may extend between lateral edge 144 and raised portion 138.

In some embodiments, raised portion 138 may be located along bisecting line 148 of lower midsole component 106. In some embodiments, raised portion 138 may be located offset from bisecting line 148. That is, in some embodiments, raised portion 138 may be skewed towards lateral edge 144, or towards medial edge 146.

In some embodiments, outer faces 140 may be linearly shaped. That is, in some embodiments, outer faces 140 may extend from upper surface 120 of base portion 136 to upper surface 152 of raised portion 138 in a completely vertical manner. In other embodiments, outer faces 140 may extend in a diagonally linear manner from upper surface 120 of base portion 136 to upper surface 152 of raised portion 138. In other embodiments, outer faces 140 may curve or bend towards upper surface 152 of raised portion 138 as depicted in FIG. 1. In still further embodiments, outer faces 140 may include irregular shapes or curves.

In some embodiments, the slope or grade of outer faces 140 may be steep. In other embodiments, the slope of outer faces 140 may be more gradual. In some embodiments in which outer faces are oriented at a gradual slope, outer faces may encompass a larger area than corresponding outer faces with a steeper slope. For example, in embodiments with a raised portion of consistent height, a steeper slope of outer faces may encompass a relatively small area in comparison to more gradual or moderately sloped outer faces.

In some embodiments, base portion 136 and raised portion 138 may be made of unitary construction. That is, in some embodiments, base portion 136 and raised portion 138 may be one continuous piece or part. In other embodiments, raised portion 138 may be a separate piece or part from base portion 136. In some embodiments, raised portion 138 may be attached to base portion 136 by adhesives, mechanical means, by heat bonding, or other techniques.

FIGS. 2 through 5 illustrate exemplary steps in an embodiment of assembling various components to form a sole structure. Referring to FIG. 2, lower midsole component 106 may be attached or joined to upper midsole component 104. In some embodiments, lower midsole component 106 and upper midsole component 104 are discrete pieces. In some embodiments, during assembly raised portion 138 of lower midsole component 106 is inserted into opening 126. In other embodiments, a material used to form upper midsole component 104 may be placed on lower midsole component 106 such that the material fills the contours of lower midsole component 106. For example, in some embodiments, the material used to form upper midsole component 104 may be sprayed upon or poured upon lower midsole component 106. Further, the material may then be allowed to cure, thereby forming upper midsole component 104.

In some embodiments, lower midsole component 106 and upper midsole component 104 may be attached by mechanical means. In some embodiments, lower midsole component 106 and upper midsole component 104 may be attached by an adhesive. In other embodiments, upper midsole component 104 and lower midsole component 106 may be attached by sewing, tacks, nails or other fastening devices. In other embodiments, upper midsole component 104 and lower midsole component 106 may be combined using thermal bonding or other techniques. As shown, in the embodiment of FIG. 2, an adhesive 200 is placed on lower midsole component 106. Adhesive 200 may be placed on base portion 136 as well as raised portion 138. In some embodiments, adhesive may also be placed on outer faces 140.

In some embodiments, adhesive 200 may bond upper surface 120 of base portion 136 to lower surface 128 of upper midsole component 104. In some embodiments, adhesive 200 may further bond outer faces 140 of lower midsole component 106 to inner faces 132 of upper midsole component 104.

Figure 3:
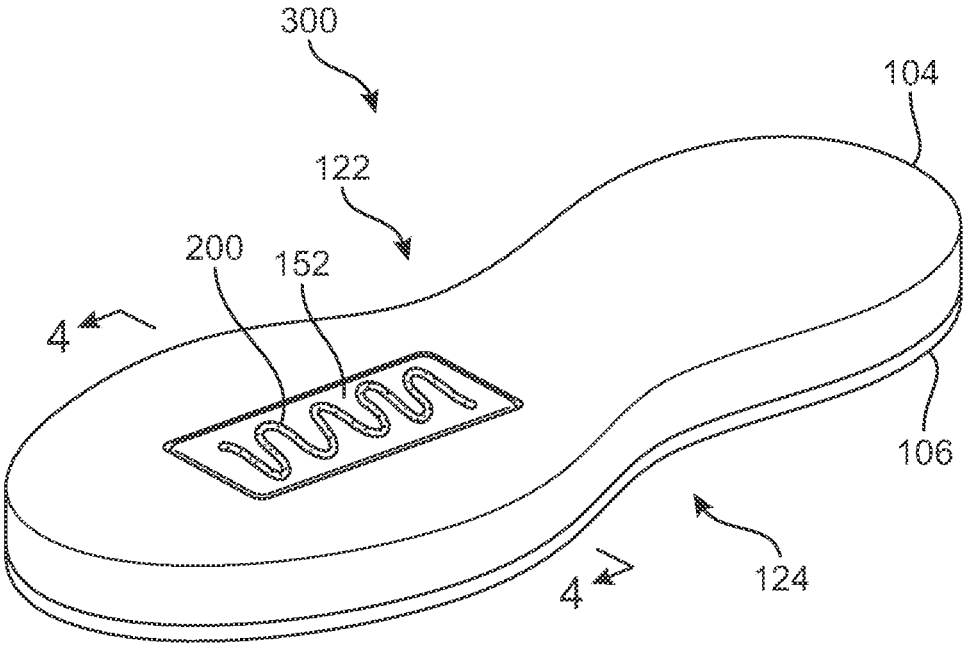
FIG. 3 is an isometric view of an embodiment of a portion of a multi-density sole structure.
Figure 4:
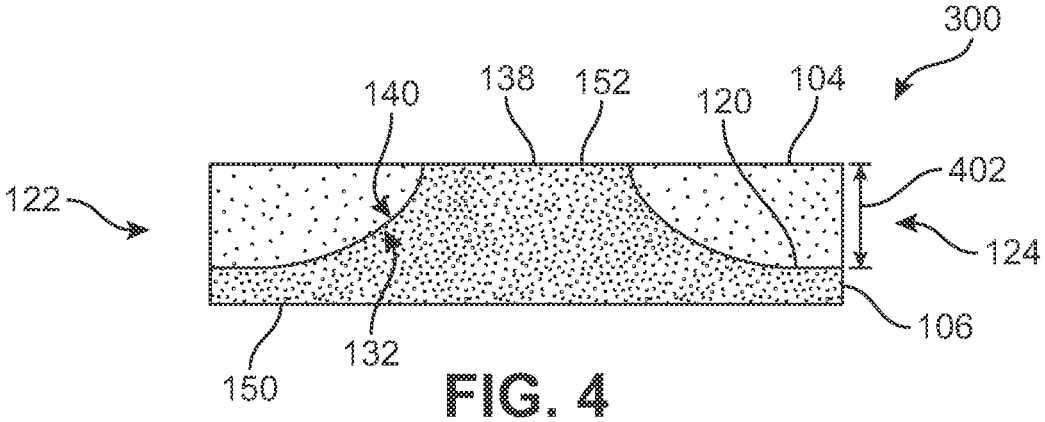
FIG. 4 is a sectional view of an embodiment of a portion of a multi-density sole structure.

Referring to FIGS. 3-4, an embodiment of midsole 300 is shown after a step of attaching upper midsole component 104 and lower midsole component 106, and prior to attaching plate 102. In some embodiments, adhesive 200 is placed on upper surface 120 of base portion 136 as well as upper surface 152 of raised portion 138. As shown, outer faces 140 may have a concave shape. Inner faces 132 may have a corresponding convex shape that aligns with the shape of outer faces 140. In some embodiments, the shape of outer faces 140 and inner faces 132 may not correspond. Further, in some embodiments, the shape of outer faces 140 and inner faces 132 may be irregularly shaped.

Referring to FIG. 4, a cross section of midsole 300 is shown. In some embodiments, the cross sectional area of upper midsole component 104 may be the same or similar on lateral side 122 and medial side 124. In other embodiments, the cross sectional area of upper midsole component 104 may differ. In some embodiments, the shape or orientation of raised portion 138 may impact the cross sectional area of upper midsole component 104. As shown, the cross-section of midsole 300 is largely rectangular. Additionally, lower midsole component 106 has a largely flat or linear lower surface. The shape of lower surface 150 of lower midsole component 106 may allow for outsoles (such as outsole 1004 in FIG. 10) of different shapes to be attached. Additionally, height 402 of raised portion 138 may be approximately the same as the thickness of upper midsole component 104. Additionally, cleats or studs may also be secured to midsole 300 and/or outsole 1004.

Figure 5:
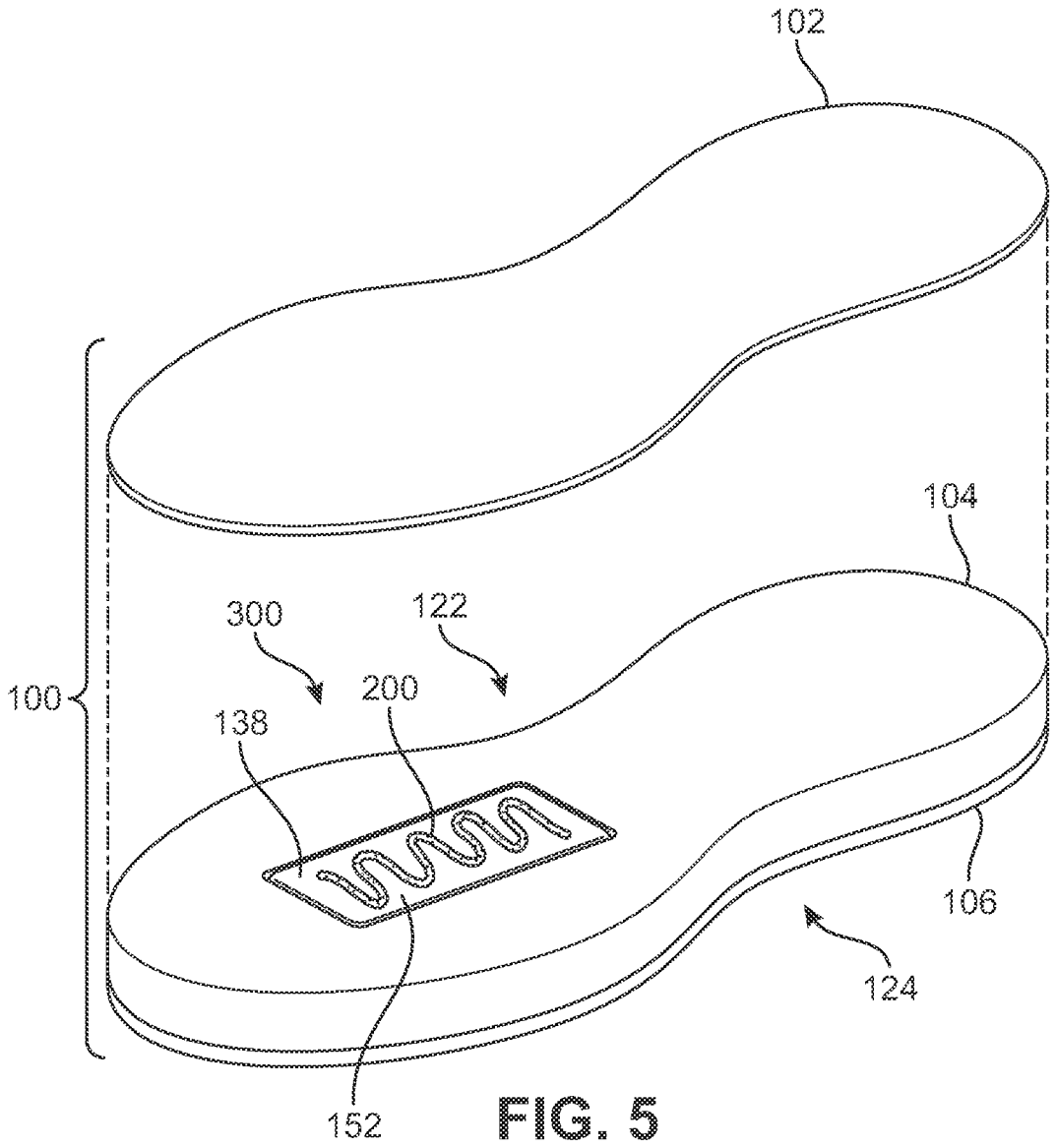
FIG. 5 is an isometric view of an embodiment of a portion of a multi-density sole structure and a plate.
Figure 6:
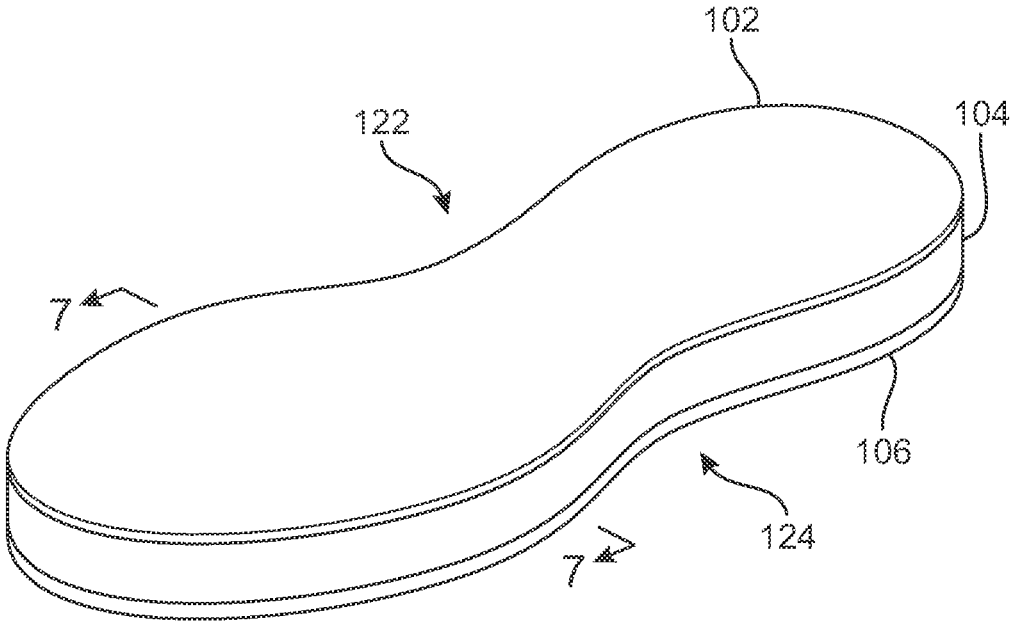
FIG. 6 is an isometric view of an embodiment of a multi-density sole structure.
Figure 7:
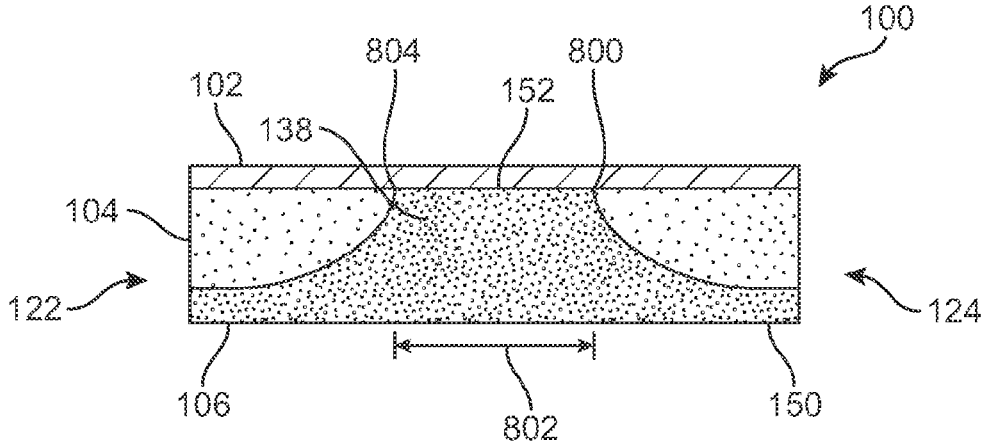
FIG. 7 is a sectional view of an embodiment of a multi-density sole structure.

Referring to FIGS. 5-7, sole structure 100 is shown. Plate 102 may be attached to midsole 300. In some embodiments, plate 102 may be attached only to upper midsole component 104. In other embodiments, plate 102 may be attached to upper midsole component 104 and lower midsole component 106. In still further embodiments, plate 102 may be attached only to lower midsole component 106. As shown, adhesive 200 may be placed on upper surface 152 of raised portion 138 of lower midsole component 106. In some embodiments, upper midsole component 104 may not include adhesive 200. That is, in some embodiments, plate 102 may be attached to lower midsole component 106 without being attached to upper midsole component 104.

Figure 8:
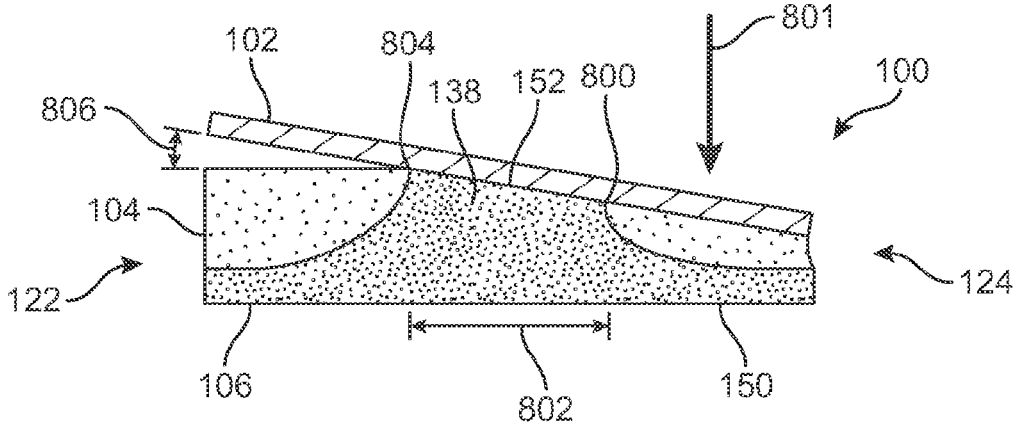
FIG. 8 is a sectional view of an embodiment of a multi-density sole structure exposed to a force.
Figure 9:
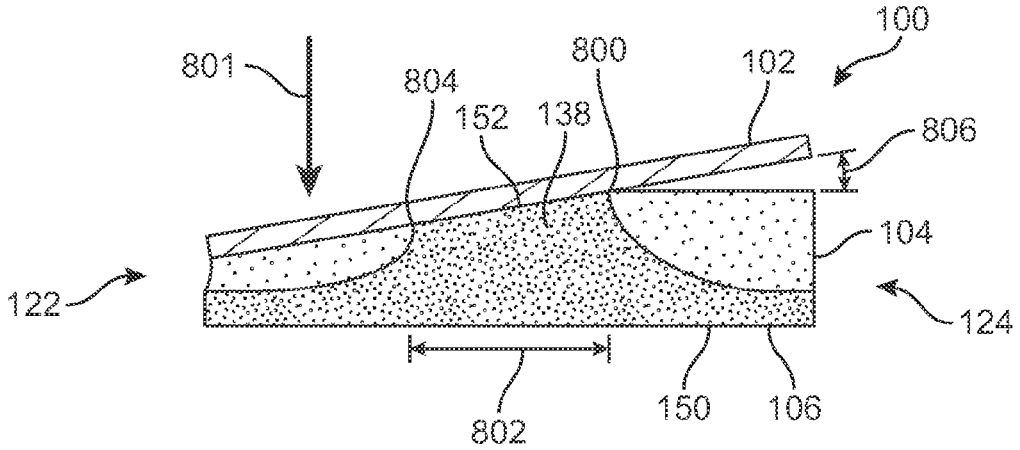
FIG. 9 is a sectional view of an embodiment of a multi-density sole structure exposed to a force.

Referring to FIGS. 8-9, a force 801 may be applied to sole structure 100. As shown, raised portion 138 may act as a fulcrum as force 801 is exerted on lateral side 122 (in FIG. 9) and medial side 124 (in FIG. 8). For example, referring to FIG. 8, as force 801 is exerted on medial side 124, plate 102 may press into upper midsole component 104. As upper midsole component 104 experiences force, upper midsole component 104 may compress, thereby allowing plate 102 to move along the direction of force 801 (e.g., vertically downward). In this manner, plate 102 may pivot about raised portion 138.

In some embodiments, plate 102 may be unsecured to upper midsole component 104. As such, in some embodiments, as force 801 is exerted on medial side 124 of plate 102, lateral side 122 of plate 102 may raise above upper midsole component 104 as shown in FIG. 8. In some embodiments, a gap or space may be formed between upper midsole component 104 and plate 102 as shown on lateral side 122 of sole structure 100. In this case, lateral side 122 of plate 102 may form a non-zero angle 806 with upper midsole component 104, which indicates the degree of titling of plate 102 under force 801. Similarly, as shown in FIG. 9, medial side 124 of plate 102 may form non-zero angle 806 with upper midsole component 104 as force 801 is applied to lateral side 122 of plate 102. Because upper midsole component 104 may be unsecured to plate 102, plate 102 may have an increased range of motion compared to embodiments in which plate 102 is attached to upper midsole component 104. In embodiments in which upper midsole component 104 is attached to plate 102 along lateral side 122, upper midsole component 104 may restrict the motion of plate 102 to lift or raise along lateral side 122. Likewise, in embodiments in which upper midsole component 104 is attached to plate 102 along medial side 124, upper midsole component 104 may restrict the motion of plate 102 to lift or raise along lateral side 122.

In some embodiments, upper surface 152 of raised portion 138 may bend or compress as a force is applied to sole structure 100. In some embodiments, medial edge 800 of raised portion 138 may compress as force 801 is applied on medial side 124 of sole structure 100. The degree to which medial edge 800 compresses may depend on the compressibility of upper midsole component 104 as well as the magnitude of the force applied. In some embodiments, the more compressible upper midsole component 104 is, the more medial edge 800 may compress.

In some embodiments, the amount medial edge 800 compresses may also depend on the width 802 of upper surface 152 of raised portion 138. Width 802 may be defined as the distance from medial edge 800 to lateral edge 804 of raised portion 138 (see FIG. 7). In embodiments with a larger width 802 than depicted in FIG. 7, medial edge 800 may compress to a lesser degree when sole structure 100 is subjected to the same force 801 of FIG. 8. Additionally, the smaller width 802 is, the more medial edge 800 may compress. Because lower midsole component 106 may be generally less compressible than upper midsole component 104, reducing the volume of lower midsole component 106 relative to the volume of upper midsole component 104 (or increasing the volume of upper midsole component 104 relative to the volume of lower midsole component 106) may result in a more compressible sole structure 100.

In some embodiments, the magnitude of force necessary to alter angle 806 of plate 102 may be impacted by width 802 of raised portion 138. In some embodiments, the greater the distance of width 802, the greater the magnitude of force is necessary to alter plate 102 to an angle 806. Conversely, in some embodiments, the smaller the distance of width 802, the smaller the magnitude of force is necessary to alter plate 102 to an angle 806.

As discussed previously, in some embodiments, raised portion 138 may be located off-center, or offset from bisecting line 148. As the gait or walk of a user may not be perfectly symmetric, raised portion 138 may be altered to accommodate the lack of symmetry. For example, some users walk or gait may place more pressure on medial side 124 of sole structure 100. As such, in some embodiments, raised portion 138 may be skewed toward medial side 124 so as to accommodate the gait of a user. By moving raised portion 138 to accommodate a user's gait, the foot of a user may be able to remain relatively horizontal and improve comfort during linear movement.

Figure 10:
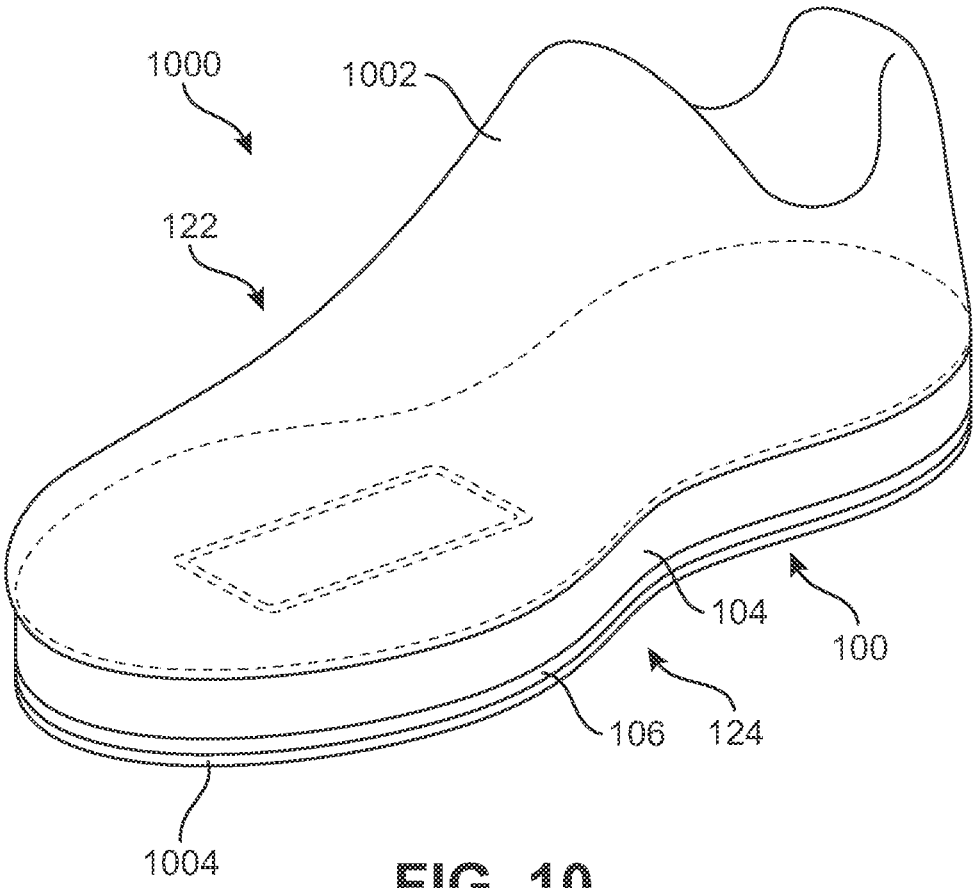
FIG. 10 is an isometric view of an embodiment of an article of footwear.

Referring to FIG. 10, an embodiment of an article of footwear 1000 (also referred to as plainly article 1000) incorporating sole structure 100 is shown. In some embodiments, article 1000 may include an upper 1002, sockliner, and/or strobel. In some embodiments, article 1000 may also include an outsole 1004 between lower midsole component 106 and the ground or a surface.

Figure 11:
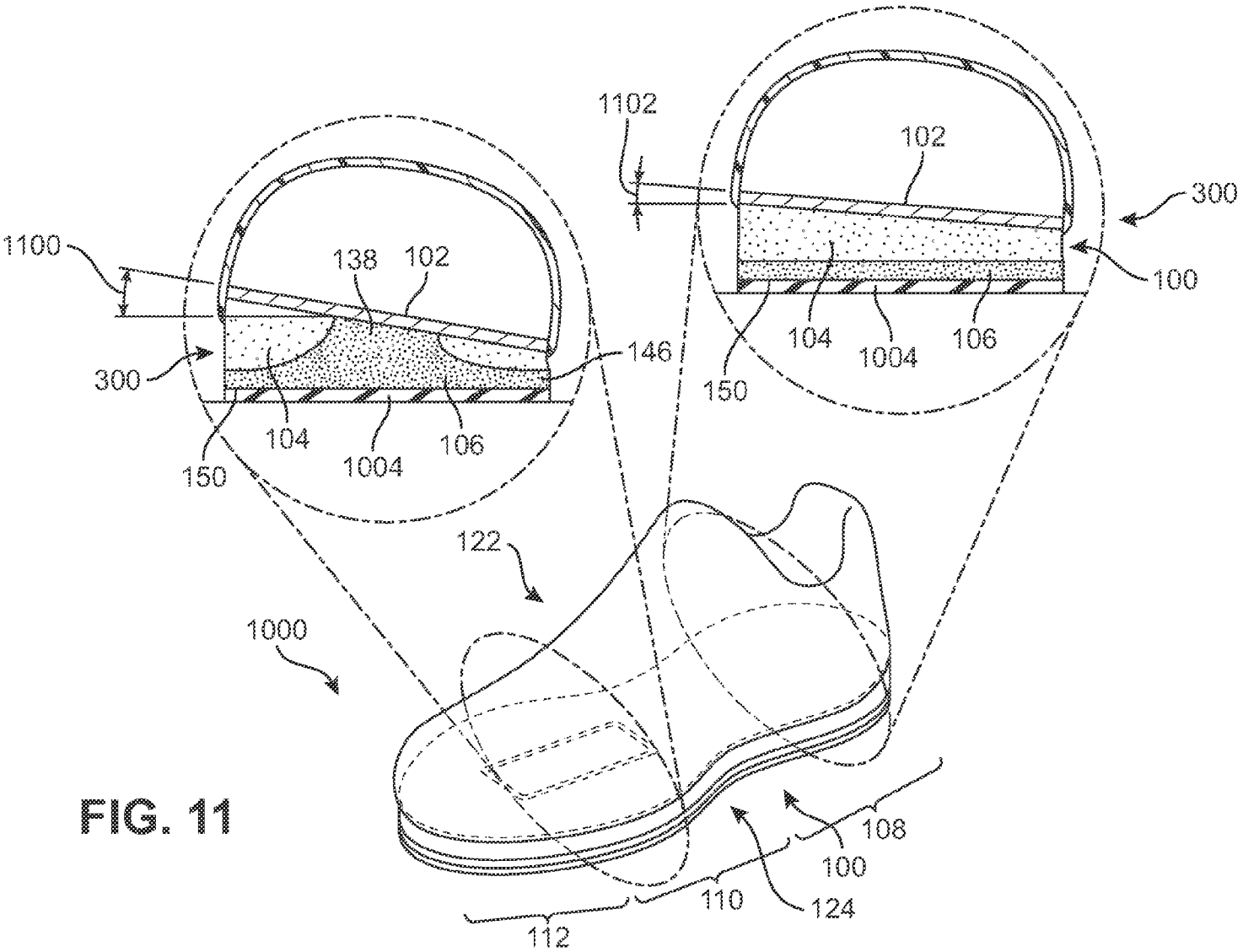
FIG. 11 is sectional view of a forefoot portion and a heel portion of an embodiment of an article of footwear.

Referring to FIG. 11, article of footwear 1000 may tilt along medial edge 146. Forces applied by a foot (not shown) may compress upper midsole component 104 along medial side 124 thereby angling plate 102. As shown in cross sections through forefoot region 112 and heel region 108, plate 102 may be oriented at different angles. Angle 1100, between plate 102 and upper midsole component 104, in forefoot region 112 may be greater than angle 1102, between plate 102 and upper midsole component 104, in heel region 108. In some embodiments, raised portion 138, which may be stiffer than upper midsole component 104, may allow for plate 102 to more readily angle or tilt in forefoot region 112 than in heel region 108. In some embodiments, because no raised portion is located in heel region 108 to act as a fulcrum, the ability of plate 102 to angle may be diminished in heel region 108.

In some embodiments, plate 102 may angle in heel region 108. In other embodiments, plate 102 and midsole 300 may be oriented at the same angle when subjected to a force. That is, in some embodiments, in heel region 108 a portion of sole structure 100 may lift off of the ground or contact surface such that a space may exist between lower midsole component 106 and the ground or contact surface when a vertical force is placed along medial side 124 of sole structure 100.

Figure 12:
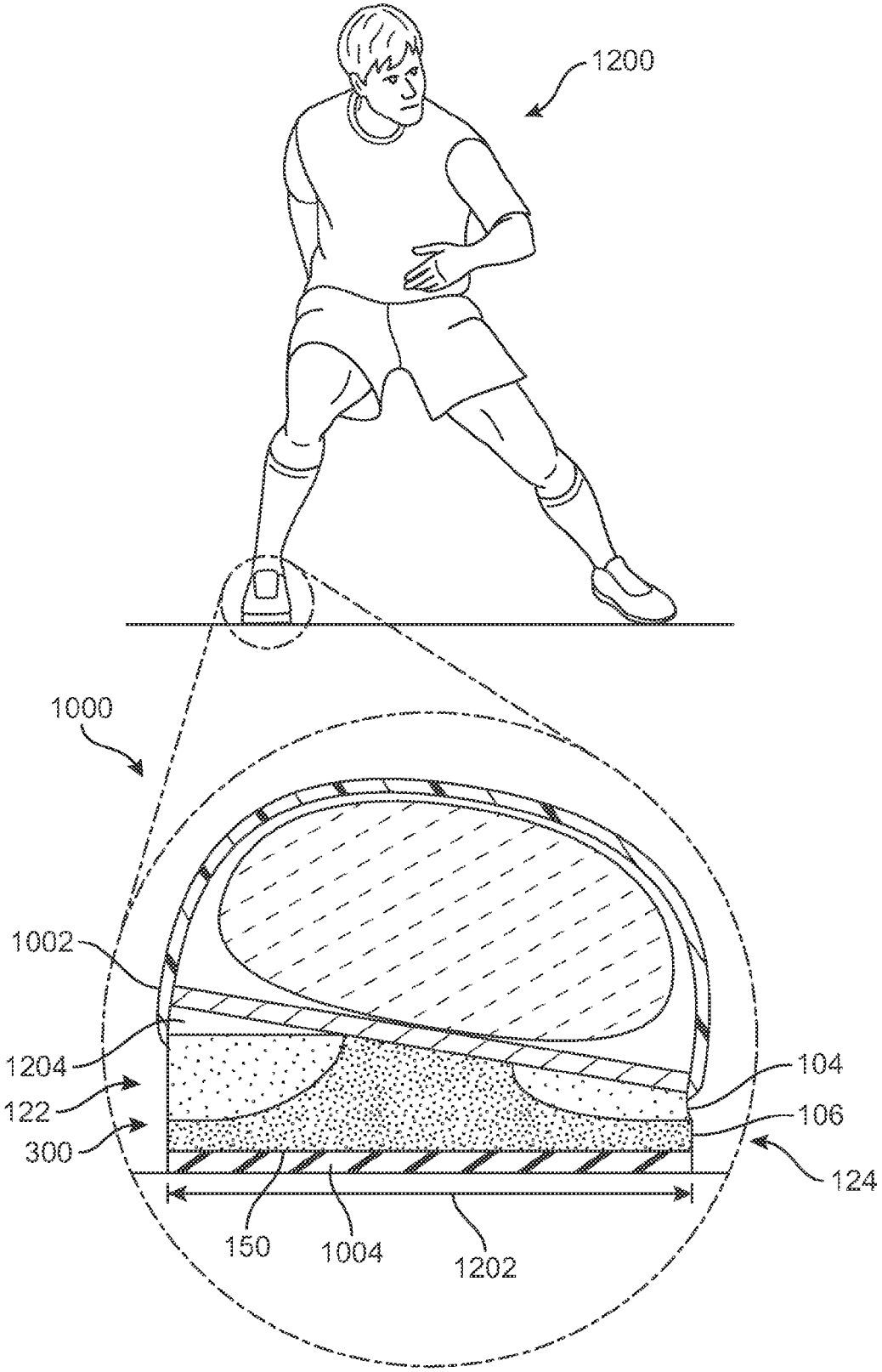
FIG. 12 is a view of a user moving in a lateral direction with an embodiment of an article of footwear utilizing a multi-density sole structure.

Referring to FIG. 12, a user is shown in a cutting motion and a cross-sectional view of the forefoot region 112 of article 1000 is shown. A cutting motion generally refers to a lateral motion, that is, a motion along the width, or from lateral side 122 to medial side 124 (or vice versa). As a user cuts, more force may be placed on one side than the other. As user 1200 is cutting, more weight is placed on medial side 124 of article 1000. As such, in this view, medial side 124 of upper midsole component 104 may be compressed more than lateral side 122 of upper midsole component 104. Additionally, a similar reaction may occur when a force is exerted on the lateral side 122 of sole structure 100.

Figure 13:
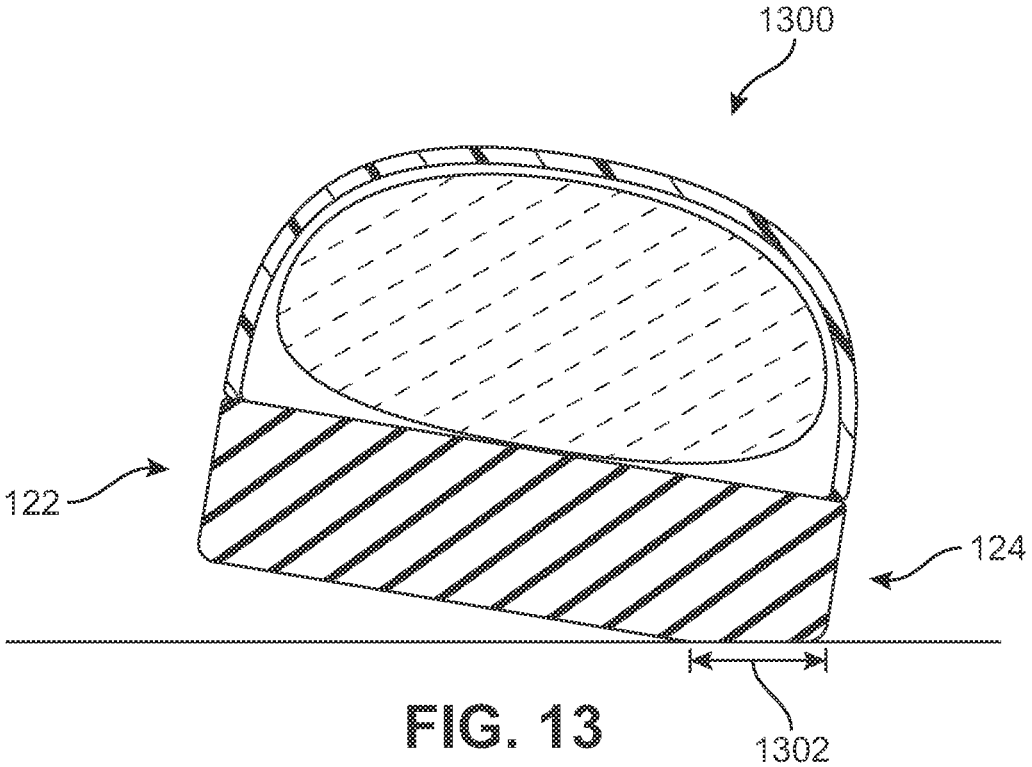
FIG. 13 is a sectional view of an article of footwear that does not utilize a multi-density sole structure.

In some embodiments, the design of sole structure 100 may increase contact area with the ground or contact surface. Referring to article 1300 of FIG. 13, article 1000 of FIG. 12 has a larger contact area 1202 than contact area 1302 of article 1300, which shows an alternative embodiment of an article with a different sole structure. As user 1200 puts pressure or force on medial side 124, the combination of lower midsole component 106 and upper midsole component 104 may absorb the force. Further, the ankle or foot of user 1200 may be able to angle with plate 102 during the cutting motion. The design may allow for a substantial majority of the ground contacting portion of sole structure 100 to remain in contact with the ground, increasing traction and control. In comparison, article 1300 does not include a similar type of force distribution mechanism. Article 1300 lacks substantial provisions for distributing the force exerted by user 1200 in a manner that maintains maximum contact area between a sole and a ground surface. As seen by comparing FIGS. 12 and 13, contact area 1302 is smaller in comparison to contact area 1202. As a user cuts with article 1300, contact area 1302 is reduced, thereby reducing traction and control.

Referring to FIG. 12, in some embodiments, gap 1204 may occur during a cutting motion. In some embodiments, gap 1204 may be separated or sealed from outside elements. In some embodiments, upper 1002 may extend across gap 1204. In some embodiments, upper 1002 may be attached to midsole 300. As such, as plate 102 angles or rotates, upper 1002 may seal gap 1204 from outside elements. In other embodiments, a separate portion may seal gap 1204 from outside elements. In still further embodiments, gap 1204 may remain exposed to outside elements.

Figure 14:
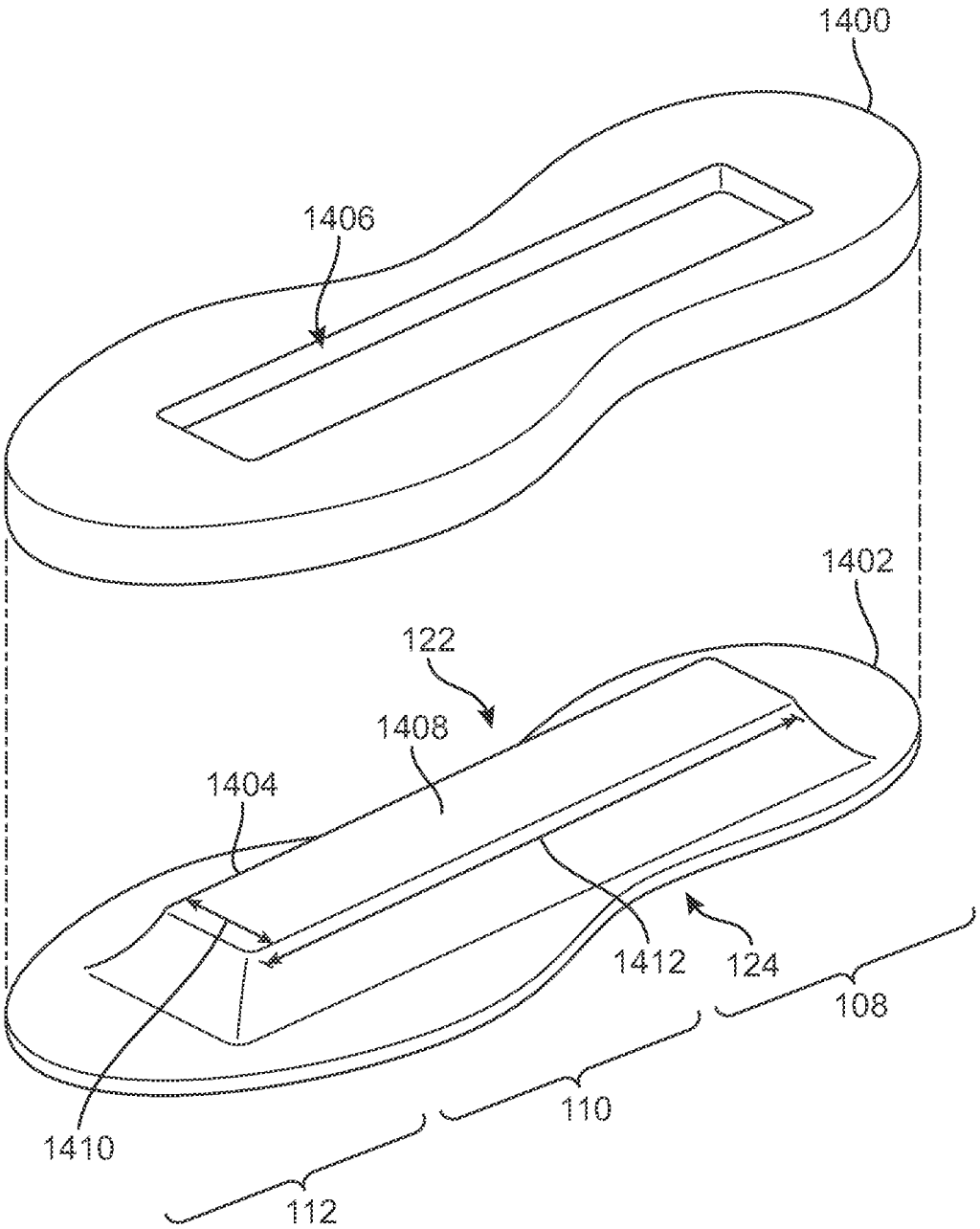
FIG. 14 is an exploded isometric view of an embodiment of two portions of a midsole.
Figure 15:
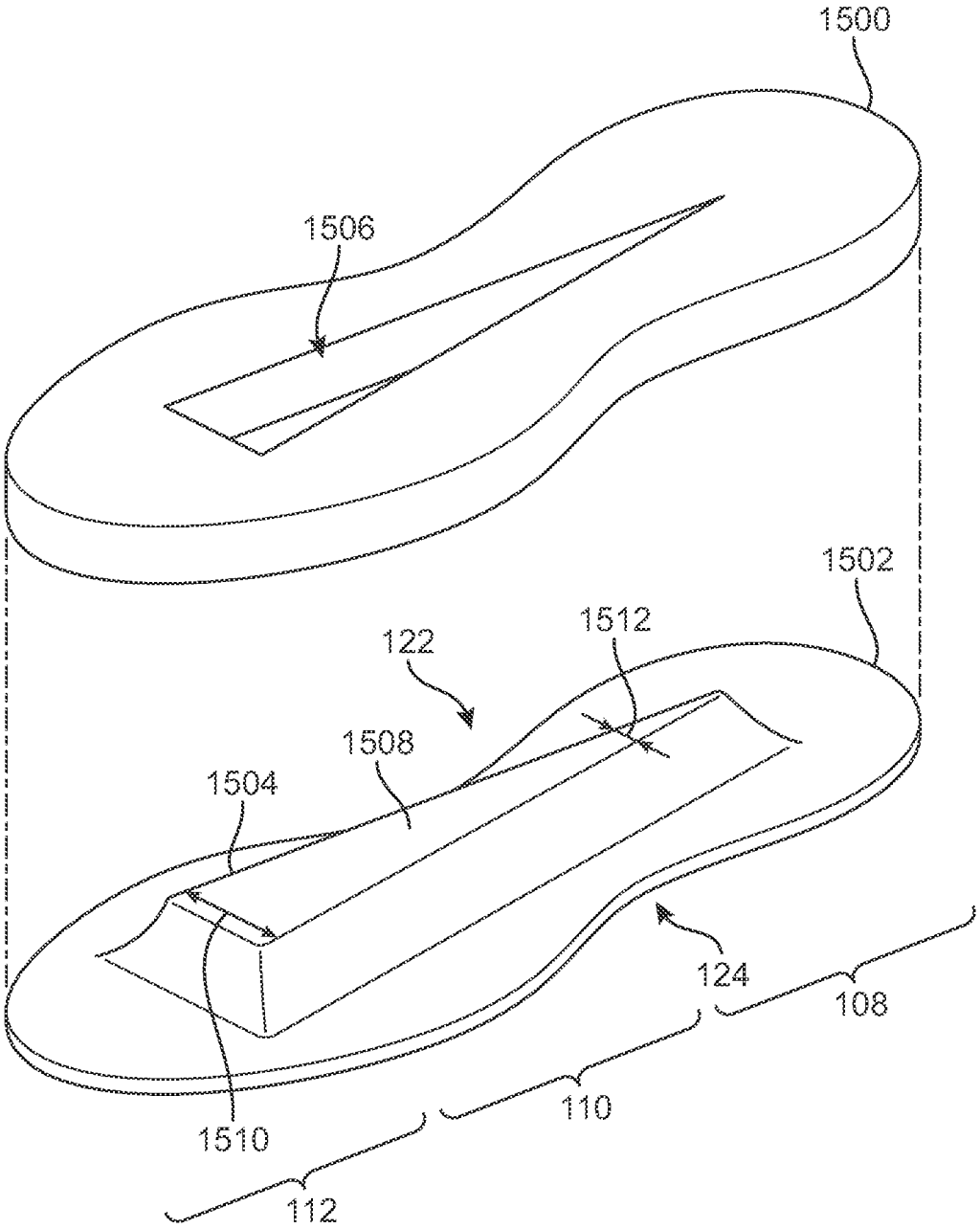
FIG. 15 is an explode isometric view of an alternate embodiment of two portions of a midsole.

Referring to FIGS. 14 and 15, in some embodiments, the raised portion may extend from forefoot region 112 to heel region 108. Referring to FIG. 14, upper midsole component 1400 and lower midsole component 1402 are depicted. As shown, raised portion 1404 of lower midsole component 1402 extends from forefoot region 112 to heel region 108. Additionally, opening 1406 extends from forefoot region 112 to heel region 108. In some embodiments, opening 1406 may correspond in shape to raised portion 1404. In FIG. 15, raised portion 1504 of lower midsole component 1502 may extend from forefoot region 112 to heel region 108. Opening 1506 of upper midsole component 1500 may correspond to raised portion 1504.

In some embodiments, the raised portion of lower midsole components may have a variety of shapes. For example, raised portion 1404 has a largely rectangular-shaped upper surface 1408. In some embodiments, the shape of upper surface 1408 may remain substantially the same throughout the length of raised portion 1404. That is, in some embodiments, width 1410 may remain substantially the same from forefoot region 112 to heel region 108. Additionally, in some embodiments, length 1412 may remain substantially the same from lateral side 122 to medial side 124. In other embodiments, width 1410 may change depending on the location within raised portion 1404. Additionally, in some embodiments, length 1412 may change between lateral side 122 and medial side 124.

In contrast to the article in FIG. 10, a user using an article that includes lower midsole component 1402 may utilize the fulcrum-like properties of raised portion 1404 in heel region 108. As a user cuts, a substantial portion of the ground contacting surfaces of an article using lower midsole component 1402 may remain in contact with the ground or other surface. The ground contacting surface may remain in contact with the ground from forefoot region 112 to heel region 108.

Referring to FIG. 15, an embodiment of a midsole structure utilizing a triangular shaped raised portion is shown. As shown, upper surface 1508 of raised portion 1504 has a generally triangular shape. In some embodiments, width 1510 in forefoot region 112 may be larger than width 1512 located towards heel region 108. In other embodiments, width 1510 may be smaller than width 1512. In still further embodiments, the width of raised portion 1504 may vary throughout the length of raised portion 1504.

In some embodiments, a triangular shaped raised portion may be utilized to provide a different feel within forefoot region 112 as opposed to heel region 108. In some embodiments, a larger surface area of raised portion 1504 may be desired in forefoot region 112 than in heel region 108. In some embodiments, a larger surface area of raised portion 1504 may increase the force necessary to angle a plate 102, as discussed previously. In some embodiments, a user may desire that greater force be needed in forefoot region 112 as opposed to in heel region 108 to angle plate 102. In other embodiments, a smaller surface area may be desired in forefoot region 112 so as to require less force to angle plate 102 in forefoot region 112. Such a configuration may be desirable in activities where the force distribution over the forefoot and heel is uneven, thereby allowing tilting at the heel even when the applied force in the heel is less than the applied force in the forefoot.

Figure 16:
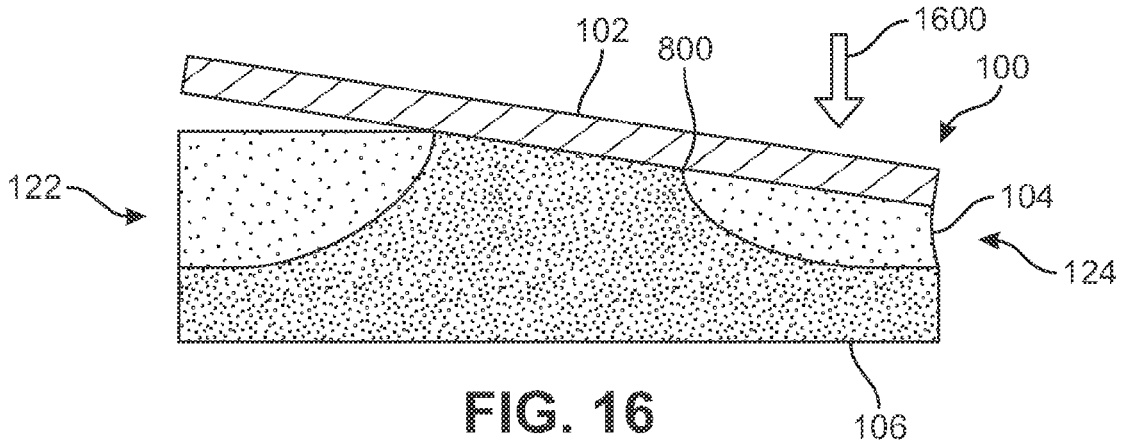
FIG. 16 is a sectional view of an embodiment of a multi-density sole structure exposed to a weak force.

Referring to FIGS. 16-19, different levels of deformation of lower midsole component 106 due to different magnitudes of force are shown. FIG. 16 shows the cross section of sole structure 100 with a force 1600 exerted upon medial side 124 of sole structure 100. As shown, plate 102 is forced into upper midsole component 104. Additionally, medial edge 800 of lower midsole component 106 may compress.

Figure 17:
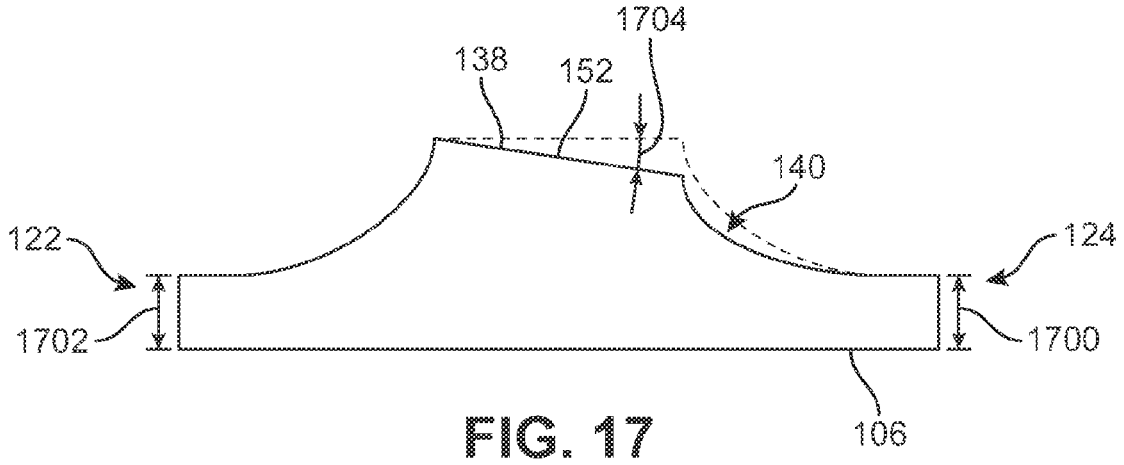
FIG. 17 is a sectional view of an embodiment of a lower layer of a multi-density sole structure.

Referring to FIG. 17, lower midsole component 106 of sole structure 100 of FIG. 16 is shown in isolation from upper midsole component 104 and plate 102. As shown, height 1700 located on medial side 124 of lower midsole component 106 and height 1702 located on lateral side 122 of lower midsole component 106 may be substantially the same. In some embodiments, as a force presses plate 102 into upper midsole component 104, upper midsole component 104 may compress and absorb most or all of the force. As such, lower midsole component 106 may only slightly deform or compress, or may not substantially be deformed at all. In some embodiments, outer faces 140 of raised portion 138 may deform or compress from an uncompressed state (represented by dashed lines) to a compressed state. As upper surface 152 of raised portion 138 compresses, an angle 1704 may be formed. In some embodiments, angle 1704 may be the angle at which plate 102 is oriented.

Figure 18:
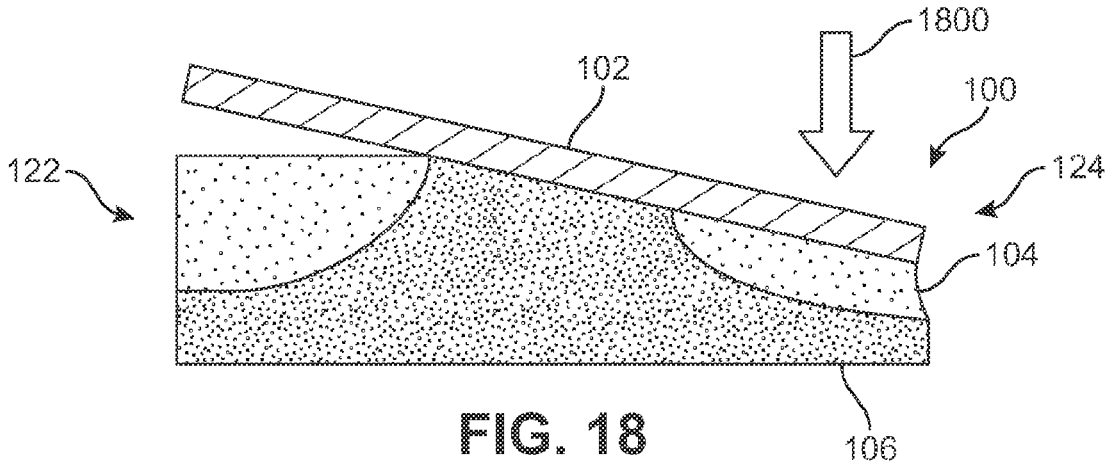
FIG. 18 is a sectional view of an embodiment of a multi-density sole structure exposed to a strong force.
Figure 19:
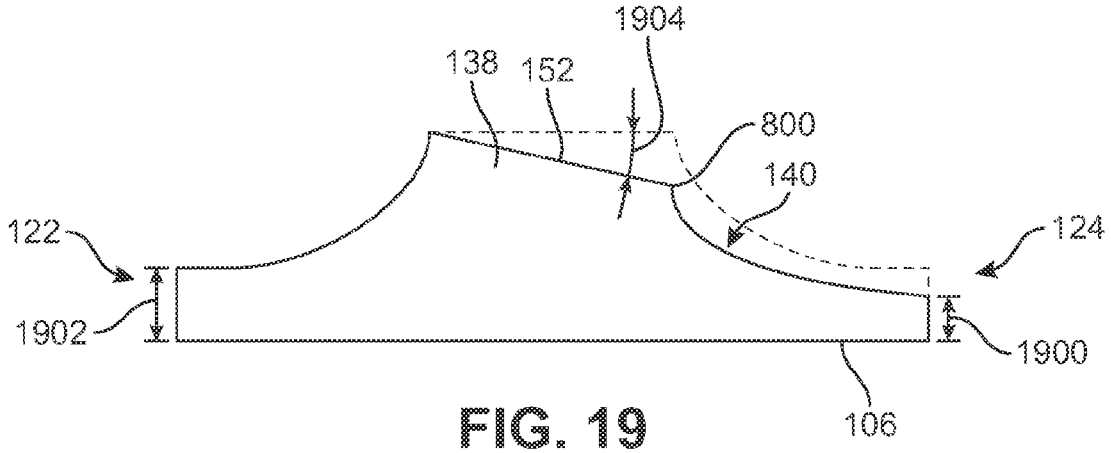
FIG. 19 is a sectional view of an embodiment of a lower layer of a multi-density sole structure.

Referring to FIGS. 18-19, sole structure 100 is exposed to a force 1800 which is of greater magnitude than force 1600 shown in FIGS. 16-17. As sole structure 100 is compressed, upper midsole component 104 may compress. In some embodiments, medial side 124 of lower midsole component 106 may compress as well.

Referring to FIG. 19, lower midsole component 106 of sole structure 100 is shown in isolation from upper midsole component 104 and plate 102. In some embodiments, force 1800 exerted upon plate 102 may transfer to upper midsole component 104 which may compress and absorb some of force 1800. In some embodiments, some of force 1800 may not be absorbed by upper midsole component 104 and the residual force may be transferred to lower midsole component 106.

In some embodiments, lower midsole component 106 may compress. As shown, height 1900 located on medial side 124 of lower midsole component 106 may be less than height 1902 located on lateral side 122 of lower midsole component 106. Additionally, as shown, outer faces 140 of raised portion 138 may compress. Compared to lower midsole component 106 of FIG. 17, lower midsole component 106 of FIG. 19 may compress to a greater degree.

In some embodiments, lower midsole component 106 may be made of a stiff or less compressible material such that under the greater force of FIG. 18, lower midsole component 106 of FIGS. 18-19 may remain the same in appearance as lower midsole component 106 of FIGS. 16-17 that is exposed to a force of less magnitude.

In some embodiments, a greater magnitude of force may cause upper surface 152 to compress to a greater degree. In some embodiments, angle 1904 may be larger than angle 1704 of FIG. 17. As medial side 124 of sole structure 100 is exposed to a greater force, medial edge 800 may compress to a greater degree. In some embodiments, as medial edge 800 is compressed, the angle at which plate 102 is oriented may increase. In some embodiments the angle at which plate 102 is oriented may be similar or the same to angle 1904.

Figure 20:
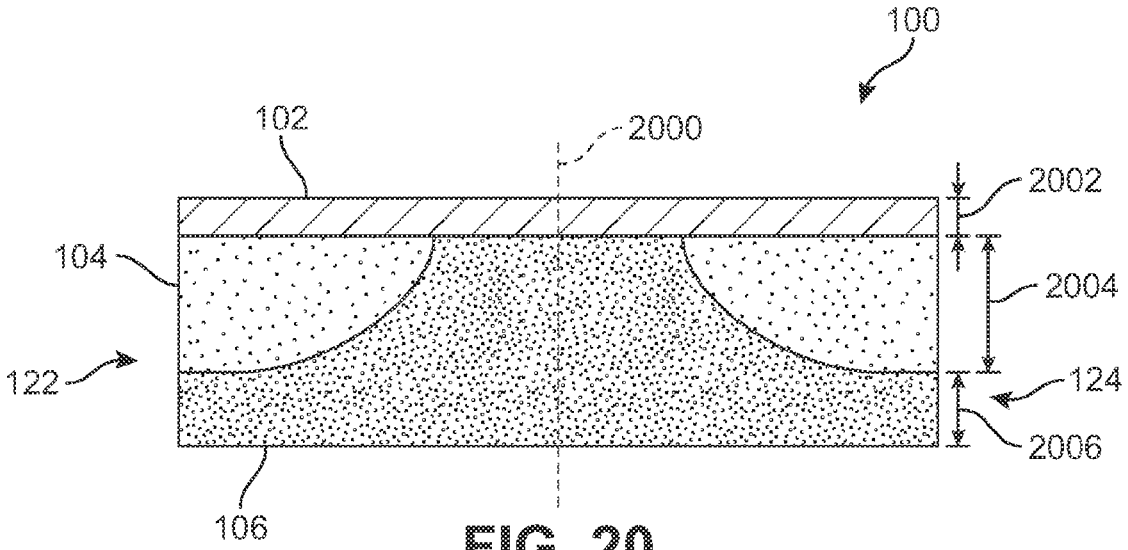
FIG. 20 is a sectional view of an embodiment of a multi-density sole structure.
Figure 21:
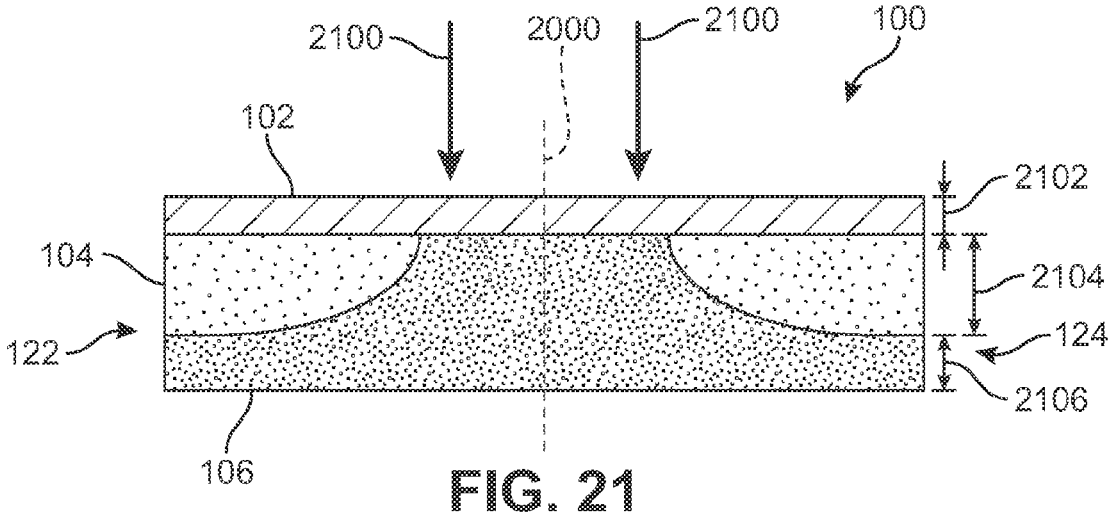
FIG. 21 is a sectional view of an embodiment of a multi-density sole structure exposed to a force.

Referring to FIGS. 20-21, sole structure 100 is shown subjected to an evenly distributed force 2100 parallel to bisecting line 2000. In some embodiments, distributed force 2100 parallel to bisecting line 2000 may evenly distribute between medial side 124 and lateral side 122. In other embodiments, force along bisecting line 2000 may distribute unevenly between medial side 124 and lateral side 122.

Referring to FIG. 20, an uncompressed sole structure 100 is shown. In FIG. 21 sole structure 100 is shown in a compressed state. In some embodiments, sole structure 100 in a compressed state may have a shorter height than sole structure 100 in an uncompressed state. In some embodiments, upper midsole component 104 may compress and change height. In other embodiments, lower midsole component 106 may compress and change height. As shown, height 2004 of uncompressed sole structure 100 in FIG. 20 is larger or greater than height 2104 of lower midsole component 106 when compressed in FIG. 21. Additionally, in some embodiments, height 2006 may be larger or greater than height 2106 of lower midsole component 106 when sole structure is subjected to a force.

In some embodiments, plate 102 may retain approximately the same dimensions when a force is applied. For example, height 2002 of plate 102 for uncompressed sole structure 100 may be the same or similar to height 2102 of plate 102 for compressed sole structure 100 of FIG. 21.

Figure 22:
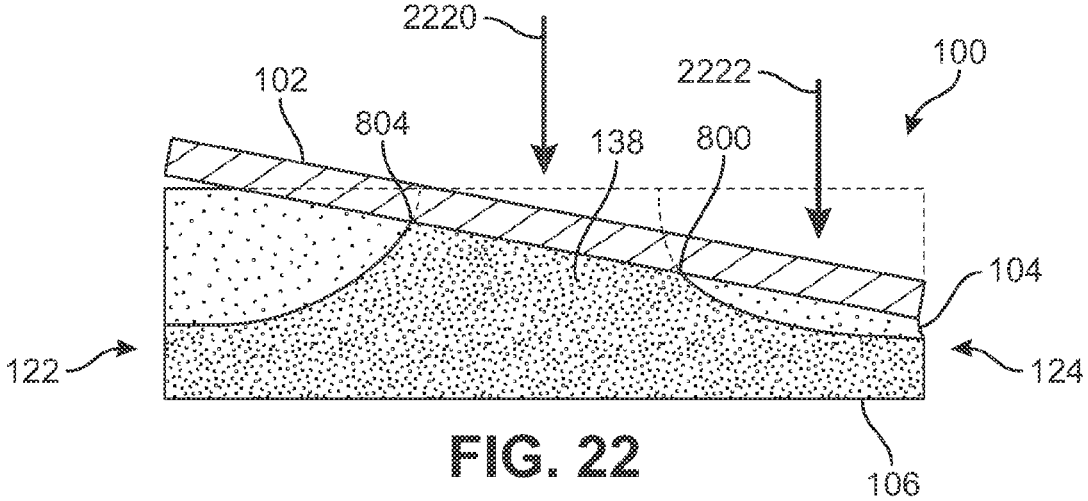
FIG. 22 is a sectional view of an embodiment of a multi-density sole structure exposed to a force.

Referring to FIG. 22, a sole structure is shown subjected to forces which are not evenly distributed. Force 2220 is exerted in a vertical direction in a central area of sole structure 100. Force 2222 is exerted in a vertical direction on medial side 124 of sole structure 100. Such a force profile could be encountered when a user is cutting while pressing down toward the ground.

In some embodiments, upper midsole component 104 may be compressed. In some embodiments, plate 102 may press against medial side 124 of upper midsole component 104. In some embodiments, plate 102 may also press against lateral side 122 of midsole component 104. As such, upper midsole component 104 may be compressed along medial side 124 as well as along lateral side 122. Additionally, medial side 124 may be compressed to a different degree than lateral side 122 of upper midsole component 104.

In some embodiments, raised portion 138 may be compressed. In some embodiments, medial edge 800 may compressed. Additionally, in some embodiments, lateral edge 804 may also be compressed. As such, each edge of raised portion 138 may be compressed different amounts.

Figure 23:
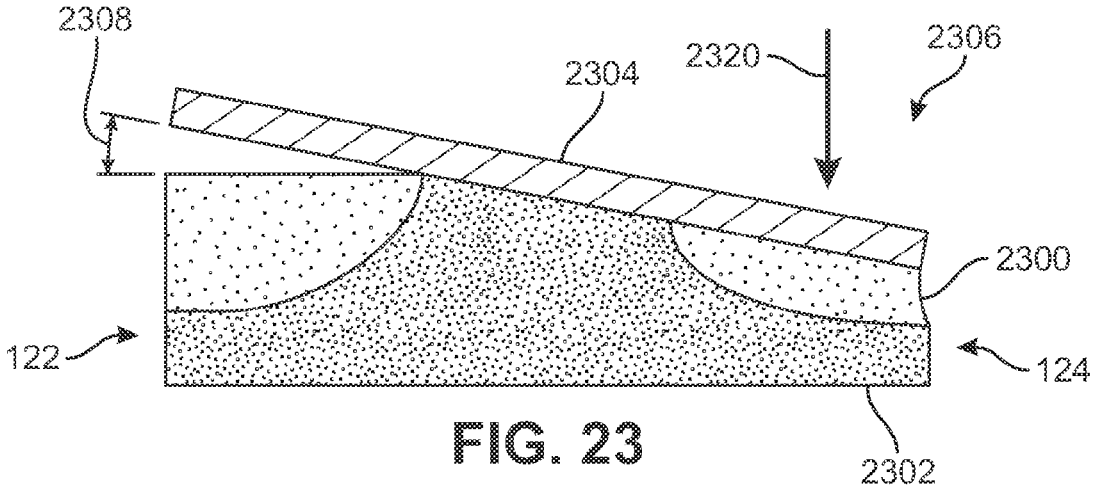
FIG. 23 is a sectional view of an embodiment of a multi-density sole structure exposed to a force.
Figure 24:
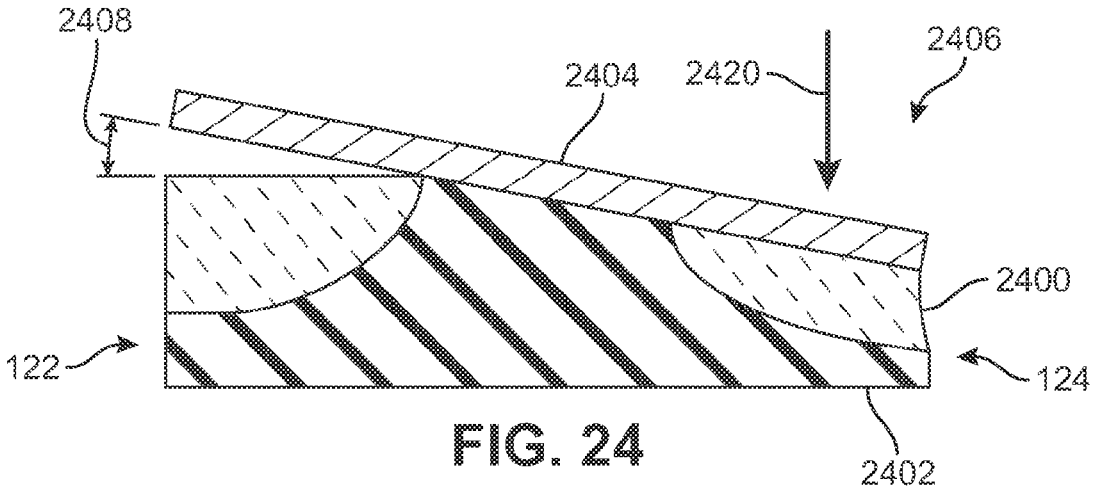
FIG. 24 is a sectional view of an embodiment of a multi-density sole structure exposed to a force.
Figure 25:
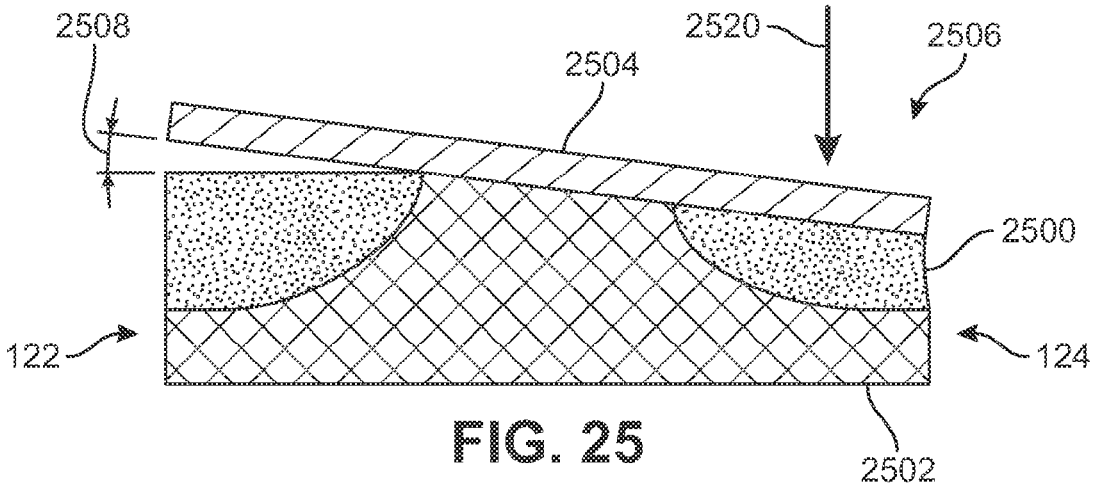
FIG. 25 is a sectional view of an embodiment of a multi-density sole structure exposed to a force.

In some embodiments, the density or compressibility of midsole components may be varied to achieve particularized compressibility within an article of footwear. Referring to FIGS. 23-25, upper midsole and lower midsole properties may be altered to achieve various properties. Additionally, the sole structures in FIGS. 23-25 may be exposed to the same magnitude of force at the same point along a plate.

Referring to FIG. 23, upper midsole component 2300 may be made of a less dense or more compressible material than lower midsole component 2302. Additionally, plate 2304 may be made of a stiff or relatively incompressible material. In some embodiments, as force 2320 is placed on medial side 124 of sole structure 2306, medial side 124 of upper midsole component 2300 may compress and change height (e.g., thickness). In some embodiments, lower midsole component 2302 may also compress and change height (e.g., thickness) to a relatively small degree compared to upper midsole component 2300. Further, as force 2320 is placed on plate 2304, plate 2304 may be oriented at an angle 2308.

Referring to FIG. 24, sole structure 2406 may comprise an upper midsole component 2400, a lower midsole component 2402 and a plate 2404. As force 2420 is exerted on medial side 124 of sole structure 2406, upper midsole component 2400 may compress a small amount. Additionally, lower midsole component 2402 may compress to a small amount. In this embodiment, the density or compressibility of lower midsole component 2402 and upper midsole component 2400 may be closer to each other than is the compressibility of upper midsole component 2300 and lower midsole component 2302 shown in FIG. 23. That is, upper midsole component 2400 may be less compressible than upper midsole component 2300. Lower midsole component 2402 may be more compressible than lower midsole component 2302. In some embodiments, lower midsole component 2402 may still be less compressible than upper midsole component 2400.

Additionally, plate 2404 may be oriented at an angle 2408. In some embodiments, angle 2408 may be the same or similar to angle 2408. As such, different combinations of upper midsole component compositions and lower midsole component compositions may be used in order to achieve the same results. That is, in some embodiments, the overall compressibility of a sole structure may be achieved in many alternative ways.

In some embodiments, a stiffer lower midsole component may be desired for determining an initial resistance when cutting. That is, in some embodiments, as a force is exerted on a side of the plate attached to a lower midsole component, the stiffer lower midsole component portion may have a certain resistance to allowing the plate to pitch or angle. In other embodiments, a more flexible or compressible lower midsole component may be desired in order to allow immediate feedback and angling upon cutting.

Referring to FIG. 25, a relatively stiff sole structure 2506 is shown. Sole structure 2506 includes upper midsole component 2500, lower midsole component 2502, and plate 2504. As force 2520 is applied to plate 2504 on medial side 124 of sole structure 2506, sole structure 2506 may compress. As shown, upper midsole component 2500 may be less compressible than upper midsole component 2400 or upper midsole component 2300.

Upper midsole component 2500 may be more compressible than lower midsole component 2502. In some embodiments, lower midsole component 2502 may be less compressible than lower midsole component 2402 or lower midsole component 2302. As such, sole structure 2506 may be made of midsole components that are less compressible than corresponding components in FIGS. 23 and 24.

Due to the less compressible nature of sole structure 2506, plate 2504 may angle to a smaller extent than plate 2404 or plate 2304. In some embodiments, angle 2508 may be smaller than angle 2408 and angle 2308. The less compressible composition of sole structure 2506 may be used in embodiments in which a stiffer feel may be desired. For example, in some embodiments, a user may desire to have plate 2504 angle only on stronger cuts. In such cases, a user may desire to have a stiffer sole structure composed of less compressible materials such as shown in FIG. 25.

It will be understood that other embodiments could utilize any combinations of a plate and midsole components having any desired compressibility, stiffness and/or other properties. The material properties for each component can be selected to tune the cushioning, support, traction and/or dynamic motion (e.g., titling) provided by a sole structure.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure comprising:

an upper midsole component having an upper surface, a lower surface, and an opening extending through the upper midsole component;

a lower midsole component having an upper surface in contact with the lower surface of the upper midsole component and a raised portion extending from the upper surface of the lower midsole component and through the opening of the upper midsole component, the raised portion including an upper surface located in the same plane as the upper surface of the upper midsole component;

a plate contacting the upper surface of the upper midsole component and the upper surface of the raised portion, the plate being secured to the upper surface of the raised portion and unsecured to the upper midsole component; and an outsole is located adjacent to a lower surface of the lower midsole component.

2. The sole structure according to claim 1, wherein the upper midsole component is more compressible than the lower midsole component, and wherein the lower midsole component is more compressible than the plate.

3. The sole structure according to claim 2, wherein the upper midsole component is made of a first foam, wherein the lower midsole component is made of a second foam, and wherein the first foam is different than the second foam.

4. The sole structure according to claim 1, wherein the raised portion is located in a forefoot region of the sole structure.

5. The sole structure according to claim 1, wherein a shape of the raised portion of the lower midsole component corresponds to a shape of the opening in the upper midsole component.

6. The sole structure according to claim 1, wherein the raised portion includes at least one side surface that tapers in a direction from a junction of the raised portion and the upper surface of the lower midsole component to the upper surface of the raised portion.

7. The sole structure according to claim 1, wherein the upper surface of the raised portion is flush with the upper surface of the upper midsole component across the opening.

8. An article of footwear having an upper and a sole structure, the sole structure comprising:

an upper midsole component having an upper surface, a lower surface, and an opening extending through the upper midsole component;

a lower midsole component having an upper surface in contact with the lower surface of the upper midsole component and a raised portion extending from the upper surface of the lower midsole component and into the opening of the upper midsole component, the raised portion having an upper surface located in the same plane as the upper surface of the upper midsole component;

a plate contacting the upper surface of the upper midsole component and the upper surface of the raised portion, the plate being secured to the upper surface of the raised portion and unsecured to the upper midsole component; and an outsole is located adjacent to a lower surface of the lower midsole component.

9. The article of footwear according to claim 8, wherein the upper is secured to the upper midsole component.

10. The article of footwear according to claim 8, wherein the raised portion is located in a forefoot region of the sole structure.

11. The article of footwear according to claim 10, wherein a height of the raised portion is substantially the same as a thickness of the upper midsole component.

12. The article of footwear according to claim 8, wherein the upper surface of the lower midsole component is spaced from the plate.

13. The article of footwear according to claim 8, wherein the raised portion of the lower midsole component and the upper surface of the lower midsole component are of unitary construction.

14. The article of footwear according to claim 8, wherein the upper midsole component is made of a first material having a first rigidity, the lower midsole component is made of a second material having a second rigidity, and the plate is made of a third material having a third rigidity, the third rigidity being greater than the second rigidity, and the second rigidity being greater than the first rigidity.

15. The article of footwear according to claim 8, wherein the raised portion includes at least one side surface that tapers in a direction from a junction of the raised portion and the upper surface of the lower midsole component to the upper surface of the raised portion.

16. The article of footwear according to claim 8, wherein the upper surface of the raised portion is flush with the upper surface of the upper midsole component across the opening.

17. A method of making a sole structure comprising:

providing a lower midsole component having a raised portion extending from an upper surface thereof and an upper midsole component having an upper surface, a lower surface, and an opening formed through the upper midsole component;

positioning the raised portion within the opening of the upper midsole component such that an upper surface of the raised portion is located within the same plane as the upper surface of the upper midsole component;

joining the upper surface of the lower midsole component to the lower surface of the upper midsole component;

locating a plate to contact the upper surface of the raised portion and the upper surface of the upper midsole component;

securing the plate to the upper surface of the raised portion such that the plate remains unsecured to the upper surface of the upper midsole component; and further comprising attaching an outsole adjacent to a lower surface of the lower midsole component.

18. The method according to claim 17, providing the upper midsole component being more compressible than the lower midsole component, and providing the plate being less compressible than the lower midsole component.

19. The method according to claim 17, further comprising orienting the raised portion such that a portion of the upper midsole component is located along a lateral side, a medial side, a front side, and a rear side of the raised portion.

20. The method according to claim 17, further comprising aligning a plurality of inner faces defining the opening with a plurality of outer faces of the raised portion.

* * * * *